US008297017B2

(12) United States Patent
Platt et al.

(10) Patent No.: US 8,297,017 B2
(45) Date of Patent: Oct. 30, 2012

(54) PRECAST COMPOSITE STRUCTURAL FLOOR SYSTEM

(75) Inventors: David H Platt, West Jordan, UT (US); John E Charchenko, West Bountiful, UT (US); Daryl G Hodgson, Lehi, UT (US); Russell J Platt, Holladay, UT (US)

(73) Assignee: Plattforms, Inc., Holladay, UT (US)

( * ) Notice: Subject to any disclaimer, the term of this patent is extended or adjusted under 35 U.S.C. 154(b) by 308 days.

(21) Appl. No.: 12/618,380

(22) Filed: Nov. 13, 2009

(65) Prior Publication Data

US 2010/0132283 A1 Jun. 3, 2010

Related U.S. Application Data

(63) Continuation-in-part of application No. 12/465,597, filed on May 13, 2009, now Pat. No. 8,161,691.

(60) Provisional application No. 61/053,147, filed on May 14, 2008.

(51) Int. Cl.
*E04B 5/04* (2006.01)
*E04B 5/10* (2006.01)

(52) U.S. Cl. ..... 52/319; 52/327; 52/333; 52/334; 52/414; 52/693; 52/695; 14/6; 14/73; 14/74.5

(58) Field of Classification Search ..... 52/319, 52/327, 333, 334, 414, 650.1, 650.2, 693, 52/695; 14/6, 13, 73, 74.5
See application file for complete search history.

(56) References Cited

U.S. PATENT DOCUMENTS

| | | | | |
|---|---|---|---|---|
| 644,940 | A | 3/1900 | Orr | |
| 1,891,763 | A | 12/1932 | Henderson | |
| 1,979,643 | A * | 11/1934 | Sahlberg | 52/334 |
| 2,016,616 | A | 10/1935 | Schaub | |
| 2,171,338 | A | 8/1939 | Henderson | |
| 2,184,464 | A | 12/1939 | Myers | |
| 2,294,554 | A | 9/1942 | Henderson | |
| 2,297,952 | A | 10/1942 | Friberg | |
| 2,423,695 | A | 7/1947 | Falco | |
| 2,558,946 | A * | 7/1951 | Fromson | 52/335 |

(Continued)

FOREIGN PATENT DOCUMENTS

DE 3837774 C1 5/1990

(Continued)

OTHER PUBLICATIONS

Office Action dated Sep. 6, 2011 from U.S. Appl. No. 12/465,597, filed May 13, 2009 (12 pages).

(Continued)

*Primary Examiner* — Robert Canfield
(74) *Attorney, Agent, or Firm* — Brett Peterson; Pate Peterson PLLC

(57) ABSTRACT

A composite floor panel includes a frame assembly having a base plate, a plurality of first lateral supports secured to the base plate, and a plurality of second lateral supports secured to the base plate. The first lateral supports lie in a first plane and the second lateral supports lie in a second plane. The first plane and the second plane each intersect the base plate and the first plane is disposed at an angle relative to the second plane. The composite floor panel also includes a concrete portion coupled to and supported by the first lateral supports and the second lateral supports.

25 Claims, 20 Drawing Sheets

U.S. PATENT DOCUMENTS

| | | | | | |
|---|---|---|---|---|---|
| 2,675,695 | A | | 4/1954 | Coff | |
| 2,987,855 | A | | 6/1961 | Singleton et al. | |
| 3,091,313 | A | * | 5/1963 | Colbath | 52/650.1 |
| 3,103,025 | A | * | 9/1963 | Gassner et al. | 14/6 |
| 3,210,900 | A | | 10/1965 | Sattler | |
| 3,257,764 | A | | 6/1966 | Cripe | |
| 3,282,017 | A | | 11/1966 | Rothermel | |
| 3,385,015 | A | | 5/1968 | Hadley | |
| 3,550,332 | A | | 12/1970 | Wiesman | |
| 3,567,816 | A | | 3/1971 | Embree | |
| 3,728,835 | A | * | 4/1973 | McManus | 52/334 |
| 3,800,490 | A | * | 4/1974 | Conte | 52/250 |
| 3,885,369 | A | * | 5/1975 | Ott | 52/649.2 |
| 3,893,276 | A | * | 7/1975 | Brown | 52/475.1 |
| RE29,249 | E | | 6/1977 | Rice | |
| 4,115,971 | A | * | 9/1978 | Varga | 52/334 |
| 4,282,619 | A | * | 8/1981 | Rooney | 14/6 |
| 4,300,320 | A | | 11/1981 | Rooney | |
| 4,416,099 | A | * | 11/1983 | Fiergolla et al. | 52/319 |
| 4,495,688 | A | * | 1/1985 | Longpre et al. | 29/460 |
| 4,529,051 | A | * | 7/1985 | Stolz et al. | 177/134 |
| 4,646,493 | A | | 3/1987 | Grossman | |
| 4,653,237 | A | | 3/1987 | Taft | |
| 4,700,519 | A | * | 10/1987 | Person et al. | 52/334 |
| 4,715,155 | A | * | 12/1987 | Holtz | 52/333 |
| 4,729,201 | A | * | 3/1988 | Laurus et al. | 52/334 |
| 4,741,063 | A | * | 5/1988 | Diana | 14/18 |
| 4,912,794 | A | | 4/1990 | Thivans | |
| 4,972,537 | A | | 11/1990 | Slaw, Sr. | |
| 4,991,248 | A | | 2/1991 | Allen | |
| 4,993,094 | A | * | 2/1991 | Muller | 14/77.1 |
| 5,027,713 | A | * | 7/1991 | Kindmann et al. | 104/124 |
| 5,029,426 | A | | 7/1991 | Larson et al. | |
| 5,052,309 | A | | 10/1991 | Haselwander et al. | |
| 5,131,201 | A | | 7/1992 | Larson et al. | |
| 5,279,093 | A | | 1/1994 | Mead | |
| 5,317,854 | A | | 6/1994 | Yoshida et al. | |
| 5,373,675 | A | | 12/1994 | Ellison, Jr. | |
| 5,448,866 | A | * | 9/1995 | Saito et al. | 52/414 |
| 5,596,856 | A | * | 1/1997 | Lebon | 52/334 |
| 5,671,573 | A | | 9/1997 | Tadros et al. | |
| 5,678,373 | A | | 10/1997 | Franklin et al. | |
| 5,884,442 | A | | 3/1999 | Breault | |
| 5,924,254 | A | | 7/1999 | Franklin et al. | |
| 5,978,997 | A | | 11/1999 | Grossman | |
| 6,094,878 | A | | 8/2000 | Schluter | |
| 6,668,412 | B1 | | 12/2003 | Tadros et al. | |
| 6,668,507 | B2 | | 12/2003 | Blanchet | |
| 6,708,362 | B1 | | 3/2004 | Allen | |
| 6,709,192 | B2 | | 3/2004 | Smith | |
| 6,898,908 | B2 | | 5/2005 | Messenger et al. | |
| 6,915,615 | B2 | | 7/2005 | Won | |
| 7,010,890 | B2 | | 3/2006 | DeSutter | |
| 7,275,348 | B2 | | 10/2007 | Desutter | |
| 7,448,170 | B2 | * | 11/2008 | Skendži et al. | 52/90.1 |
| 2003/0093961 | A1 | | 5/2003 | Grossman | |
| 2003/0182883 | A1 | | 10/2003 | Won | |
| 2006/0059835 | A1 | | 3/2006 | Werner | |
| 2006/0272267 | A1 | | 12/2006 | Mentado-Duran | |
| 2009/0100794 | A1 | | 4/2009 | Holmes et al. | |
| 2009/0288355 | A1 | | 11/2009 | Platt et al. | |
| 2011/0196561 | A1 | * | 8/2011 | Jorgensen | 701/23 |
| 2011/0271618 | A1 | * | 11/2011 | Platt et al. | 52/223.7 |

FOREIGN PATENT DOCUMENTS

| | | | |
|---|---|---|---|
| EP | 0011555 | A1 | 5/1980 |
| FR | 922480 | A | 6/1947 |
| GB | 1322754 | A | 7/1973 |
| JP | 2010265689 | A | 11/2010 |
| WO | 02090660 | A1 | 11/2002 |

OTHER PUBLICATIONS

Office Action dated Oct. 28, 2011 from U.S. Appl. No. 12/773,714, filed May 4, 2010 (12 pages).

International Search Report dated Jul. 30, 2010 from PCT Application No. PCT/US09/064451 filed Nov. 13, 2009 (4 pages).

Written Opinion dated Jul. 30, 2010 from PCT Application No. PCT/US09/064451 filed Nov. 13, 2009 (7 pages).

* cited by examiner

PRECAST COMPOSITE STRUCTURAL FLOOR SYSTEM

RELATED APPLICATIONS

This application is a continuation-in-part of prior U.S. patent application Ser. No. 12/465,597 entitled PRECAST COMPOSITE STRUCTURAL FLOOR SYSTEM filed May 14, 2009, which claims the benefit of U.S. Provisional Application Ser. No. 61/053,147, filed May 14, 2008 the content of each of which are hereby incorporated by reference in their entirety.

BACKGROUND

1. Field of the Invention

The present invention relates to precast composite floor systems.

2. Related Technology

Precast concrete construction is often used for commercial and industrial buildings, as well as some larger residential buildings such as apartment complexes. Precast construction has several advantages, such as more rapid erection of a building, good quality control, and allowing a majority of the building structural members to be precast. Conventional precast structures, however, suffer from several disadvantages, such as being heavy and requiring complex connections between precast members and to the rest of the building structure.

Currently, precast single tee and double tee panels are used for constructing floors. The precast single and double tees are typically eight feet wide and often between 25 and 40 feet long or longer. The single tee sections typically have a deck surface about 1.5 to 2 inches thick and a beam portion extending down from the deck surface along the longitudinal center of the deck. The beam is usually about 8 inches thick and about 24 inches tall.

Double tee panels usually have a deck surface which is about 2 inches thick and have two beams extending down from the deck. The beams are placed about four feet apart running down the length of the panel, and are about 6 inches thick and 24 inches tall. Often, after the single and double tee panels are installed, about 2 or 3 inches of concrete is placed on top of the panels.

Single and double tee panels can be heavy. Heavy floor panels can require heavier columns and beams (i.e., columns and beams with increased strength and structural integral) to support the floor panels and so on, increasing the weight of nearly every structural part of the building structure. Heavier structural elements often use more materials and are thus more expensive, require increased lateral and vertical support, and may limit the height of the building for a particular soil load bearing capacity.

SUMMARY OF THE INVENTION

In at least one example, a composite floor panel includes a frame assembly having a base plate, a plurality of first lateral supports secured to the base plate, and a plurality of second lateral supports secured to the base plate. The first lateral supports lie in a first plane and the second lateral supports lie in a second plane. The first plane and the second plane each intersect the base plate and the first plane is disposed at an angle relative to the second plane. The composite floor panel also includes a concrete portion coupled to and supported by the first lateral supports and the second lateral supports.

In at least one example, a composite floor panel includes a frame assembly including a base, a plurality of first supports each having an upper end and a lower end. The lower end of the first supports is coupled to the base. The composite floor panel also includes a plurality of second supports each having an upper end and a lower end. The lower ends of the second supports are coupled to the base. A concrete portion includes a slab portion having a top surface, a first beam portion extending away from the top surface of the slab portion, and a second beam portion extending away from the top surface of the slab portion and being spaced apart from the first beam portion. The upper ends of the first supports are coupled to the first beam portion and the upper ends of the second are coupled to the second beam portion.

A method of forming a composite panel can include securing a plurality of supports to a base plate, positioning a form with respect to the supports, and pouring concrete into the form to form a concrete portion. The concrete portion includes a slab portion with a length and a width, a first beam portion, and a second beam portion spaced apart from each other relative to the width of the slab portion, wherein each of the first beam portion and the second beam portion extend along at least a portion of the length of the slab portion and away from a top surface of the slab portion.

In at least one example, a precast structural floor system includes a plurality of girders and a plurality of composite floor panels. Each composite floor panel includes a concrete portion and a frame assembly. The concrete portion includes a concrete slab having a length and a width, a first beam portion and a second beam portion extending from a top surface of the concrete slab. The first beam portion and the second beam portion can be spaced apart from each other relative to the width of the concrete slab. Each of the first and second beam portion can extend along at least a portion of the length of the concrete slab. The frame assembly includes a base plate and at least one support assembly including first supports extending between the first beam portion and the base plate and second supports extending between the second beam portion and the base plate.

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

BRIEF DESCRIPTION OF THE DRAWINGS

Various embodiments of the present invention are shown and described in reference to the numbered drawings wherein.

Figure 1:
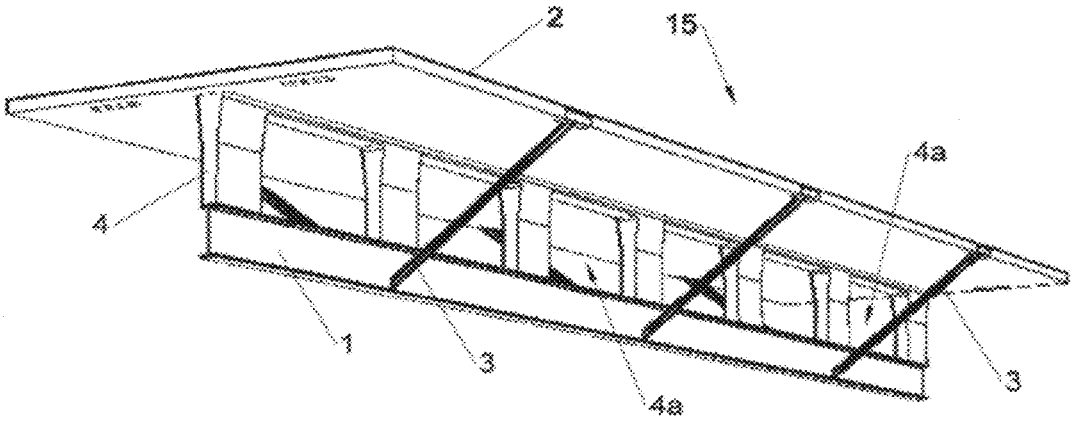
FIG. 1 is a perspective view of an exemplary embodiment of a composite panel.

It will be appreciated that the drawings are illustrative and not limiting of the scope of the invention which is defined by the appended claims. The embodiments shown accomplish various aspects and objects of the invention. It is appreciated that it is not possible to clearly show each element and aspect of the invention in a single figure, and as such, multiple figures are presented to separately illustrate the various details of the invention in greater clarity. Similarly, not every embodiment need accomplish all advantages of the present invention.

DETAILED DESCRIPTION

The invention and accompanying drawings will now be discussed in reference to the numerals provided therein so as to enable one skilled in the art to practice the present invention. The drawings and descriptions are exemplary of various aspects of the invention and are not intended to narrow the scope of the appended claims.

The present system has several advantages over conventional concrete double tee systems. The biggest advantage is the reduced weight. A conventional concrete double tee system with similar spans and loading conditions would weigh approximately 100% more per square foot than the present invention. Other structural members such as concrete girders and concrete columns that are used with double tee systems are also much heavier than columns used with the present invention. Increased weight of the double tee floor system necessitates larger footings and foundation walls. This is restrictive for taller structures and for construction in areas with poor soil bearing capacity.

The vertical legs or walls of a double tee floor panel are solid and will not allow for passage of mechanical, plumbing or electrical through the Tee, thereby increasing the floor to floor dimension because all of the utilities need to be run below the floor structure. Openings in the stem wall of the present system allow the mechanical, electrical and plumbing to pass through the structure, thereby eliminating the need to run these elements below the floor structure.

The present system also allows for greater flexibility in locating slab penetrations (openings through the floor slab) because the beams are spaced farther apart, typically 8 feet on center versus 4 or 5 feet for the legs of a double tee system.

Double tee systems are assembled by weld plates embedded in each component and must bear on concrete or masonry structures. The current system is bolted into a lighter steel structure which makes it possible to use in mid to high-rise construction.

Conventional steel and concrete composite construction also has several problems which are alleviated by the present invention. Conventional composite floor framing is very labor intensive on site. After installation of the columns for a conventionally framed floor, the rest of the materials for the conventional system are installed individually, and include the girders, joists, metal deck, nelson studs, reinforcing, edge enclosures, and poured concrete. This assembly takes much longer than the present invention due to the precast nature of the present system. With the present invention, tradesmen are able to occupy the floor to complete construction in a much shorter time frame which means shortened overall construction time.

Because of the way the calculations are performed for a conventional composite floor, the concrete that is below the top of the flute in the decking is not used in the composite section, but still contributes to the weight of the concrete in the building and the cost for that material. By precasting the floor panels, the present system has eliminated the need for the metal deck. This eliminates the material and the labor required to weld the steel deck in place.

In normal steel construction, the controlling factor over the size of the steel members is the necessity of the steel framing members to carry the full weight of the wet concrete without any of the concrete strength. In the present invention, the steel beams will be completely shored by the forms while the concrete is wet. This by itself reduces the size of the steel beam and eliminates the need for precambering the beam since the beams aren't required to support the weight of the wet concrete.

Additionally, in normal steel construction the beams are aligned so that the tops of the girders and joists are flush. This is done because the metal deck is placed on the joists and girders and the deck is used as a form for the concrete slab. When calculating the section properties for this system, the distance from the top of steel beam to the middle of the concrete is one of the biggest factors. The present invention places a composite stem wall between the steel beam and the concrete deck, thereby increasing the distance from top of the steel beam to the centerline of the concrete slab. As such, the load-bearing strength and span capabilities of the precast panel system are greatly increased. The present flooring system eliminates a significant amount of steel and concrete material as compared to a conventional poured-in-place system.

In describing the composite flooring system of the present invention, multiple views of the floor panel and girder are shown, including views of the parts thereof and cross-sectional views showing the internal construction thereof. Not every structure of the panel or girder is labeled or discussed with respect to every figure for clarity, but are understood to be part of the panel or girder.

As shown in FIG. 1, the composite floor panel 15 of the present invention is made up of steel panel beam 1, a concrete slab or floor deck 2, steel braces 3, and a concrete stem wall 4. The panel is Tee shaped, with the upper horizontal portion of the Tee being the concrete slab 2.

The concrete slab 2 is typically 3 inches thick and is supported by and connected to the concrete stem wall 4. The stem wall 4 is connected to the steel beam, which is the lower portion of the tee, by welded studs and/or rebar. The concrete and steel together form a composite floor panel.

When a beam supported at both ends is loaded the top half of the beam is under compression while the bottom half of the beam is under tension. Concrete has high compressive strength but low tensile strength, while steel has high tensile and compressive strength. In the present invention, the concrete slab at the top of the tee is under compression and the steel beam at the lower portion of the tee is under tension. The configuration of materials of the floor panel 15 utilizes the best structural properties of each material, making the panel more efficient.

The stem wall 4, for the majority of the span of the floor, can have large openings 4*a*, or blockouts. Preferably, 50 percent of the thickness of the floor deck 2 is retained at the top of the stem wall 4, leaving a small ridge as is visible in FIG. 1. One advantage to putting in these holes is that it reduces the amount of concrete needed which in turn reduces the dead load of the panels. Because of the methods used for designing composite beams, this concrete adds very little strength to the section, and is only necessary to transfer shear loads between the slab and the steel beam. The amount of concrete necessary to do this can be retained between the blockouts 4*a*. These holes are advantageous as they provide a convenient space to run HV AC ducts, piping and electrical conduit.

Diagonal braces 3 which are welded to the panel beam 1 and embedded weld plates in the slab 2 provide additional support for the slab. In a typical configuration, the floor slab 2 is about 8 feet wide and between 5 and 40 feet long. The concrete floor deck 2 is typically about 3 inches thick. The stem wall 4 is typically between 12 and 36 inches tall. The openings 4*a* in the stem wall 4 are typically located adjacent the stem wall, and may occupy the entire height of the stem wall if necessary. Thus, for an exemplary 24 inch stem wall 4, the openings 4*a* may be about 24 inches wide and 24 inches tall and have approximately 12 inch pillars of concrete between the openings. The steel beam 1 is typically about 12 inches tall and between 4 and 8 inches wide.

Figure 2:
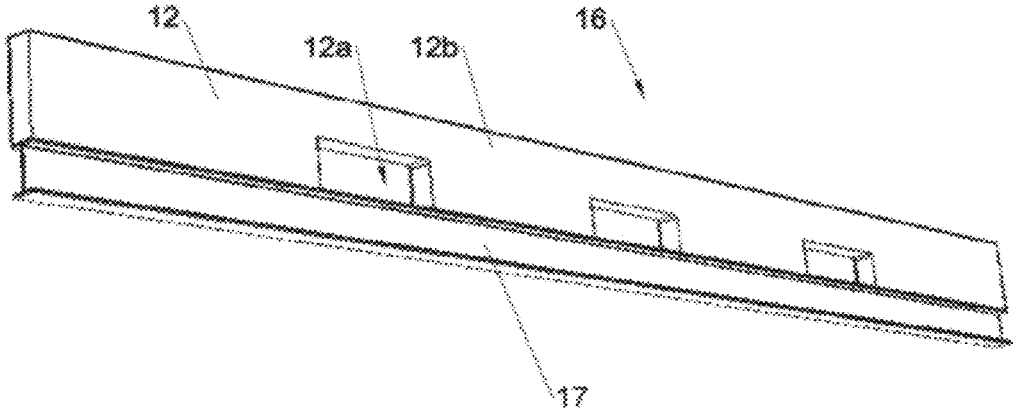
FIG. 2 is a perspective view of an exemplary embodiment of a composite panel.
Figure 3:
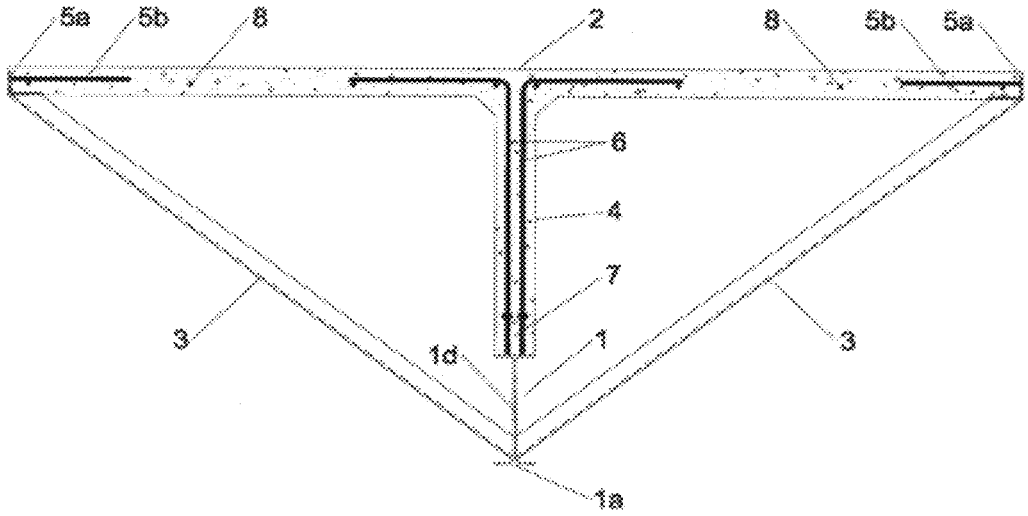
FIG. 3 is a cross-sectional view of an exemplary embodiment of the composite panel of FIG. 1.
Figure 4:
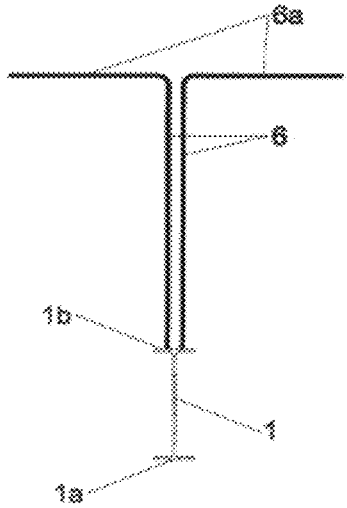
FIG. 4 is a cross-sectional view of an exemplary embodiment of a panel beam with attached vertical L-shaped rebar.
Figure 5:
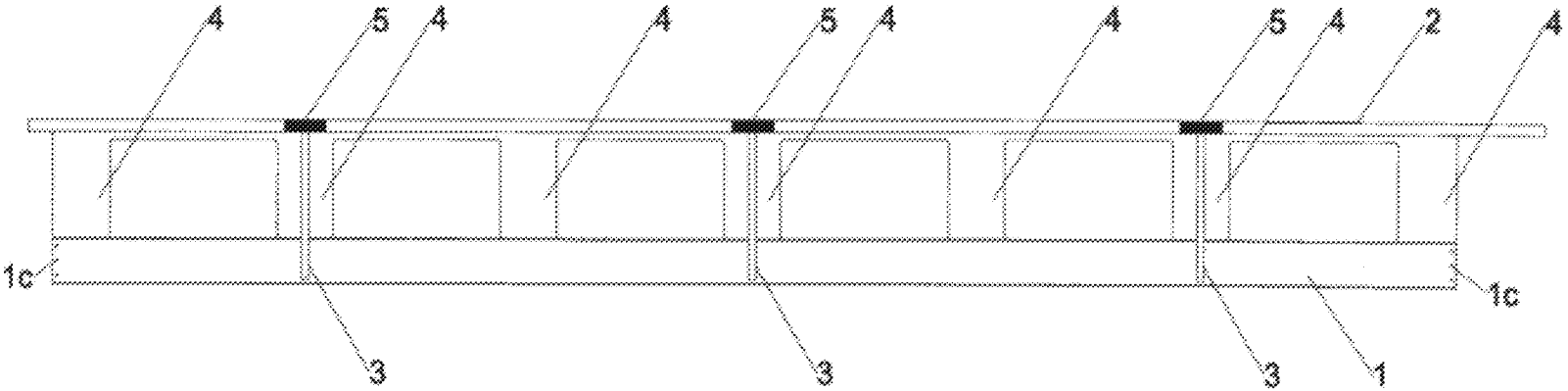
FIG. 5 is a side elevation view of an exemplary embodiment of a composite panel.
Figure 6:
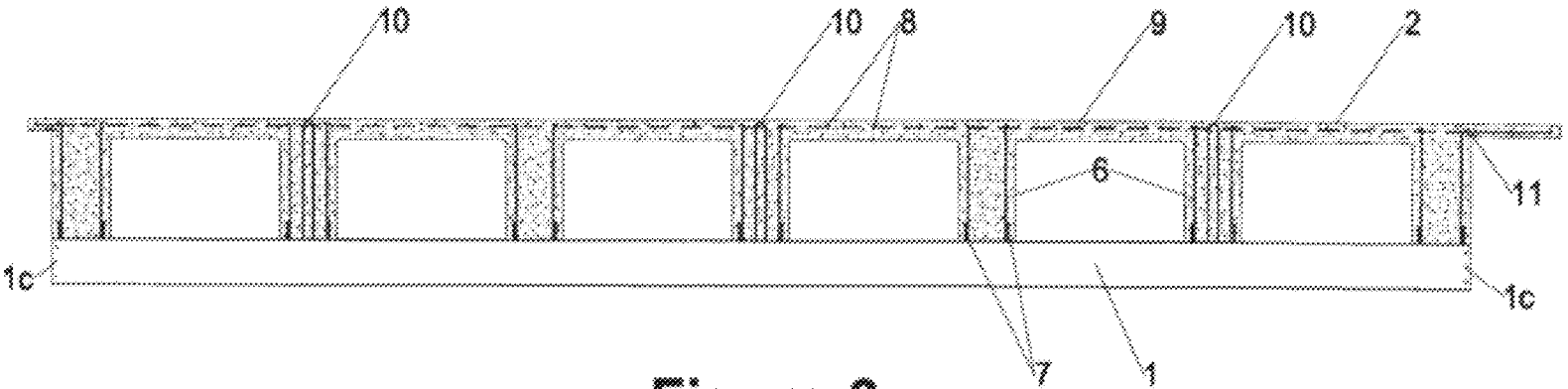
FIG. 6 is a cross-sectional side elevation view of an exemplary embodiment of a composite panel.
Figure 7:
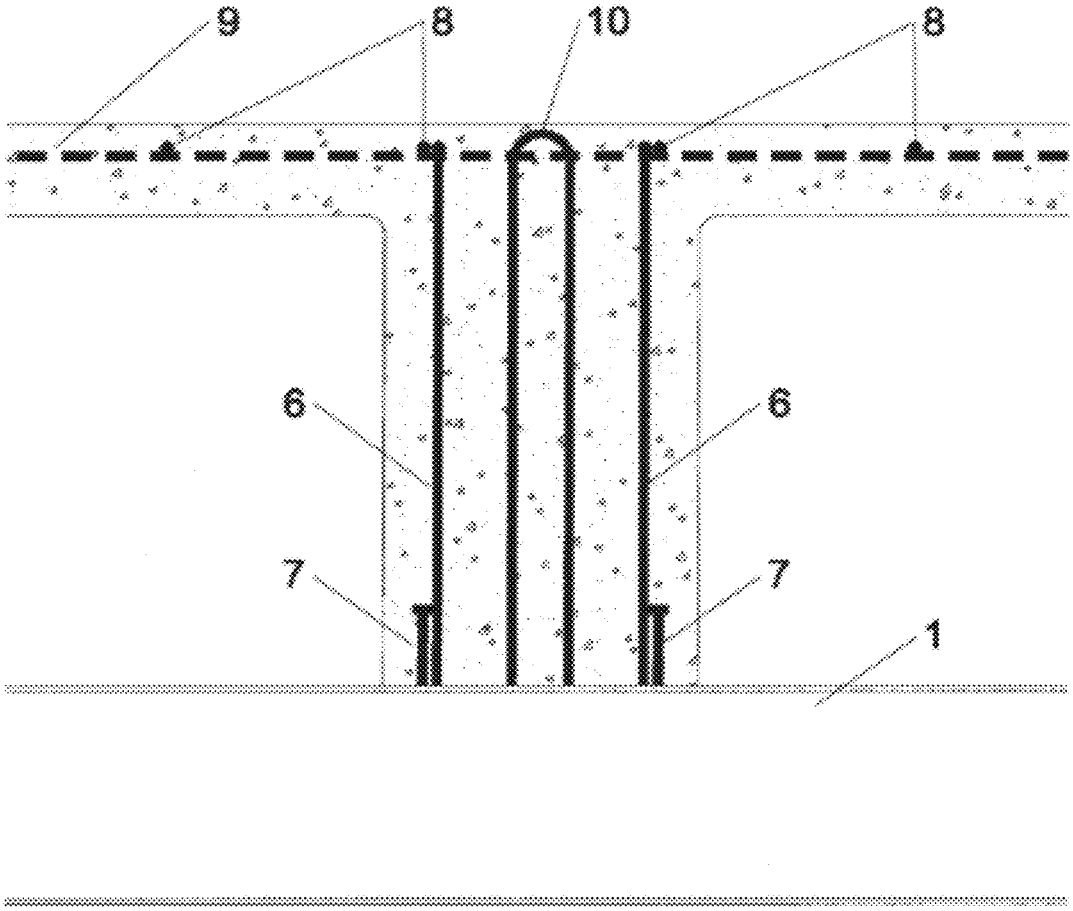
FIG. 7 is a partial cross-sectional side elevation view of an exemplary embodiment of a composite panel.
Figure 8:
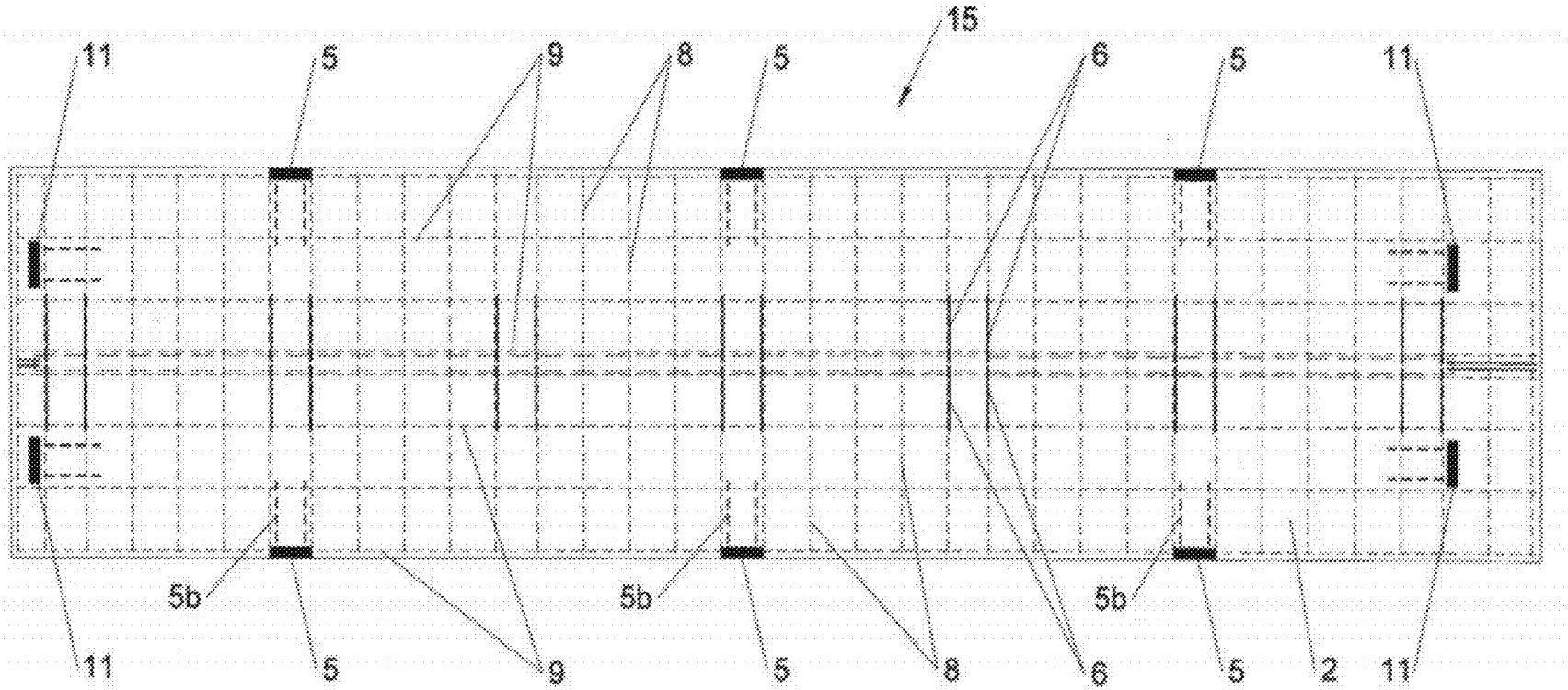
FIG. 8 is a cross-sectional plan view of an exemplary embodiment of a composite panel at mid-slab level.
Figure 9:
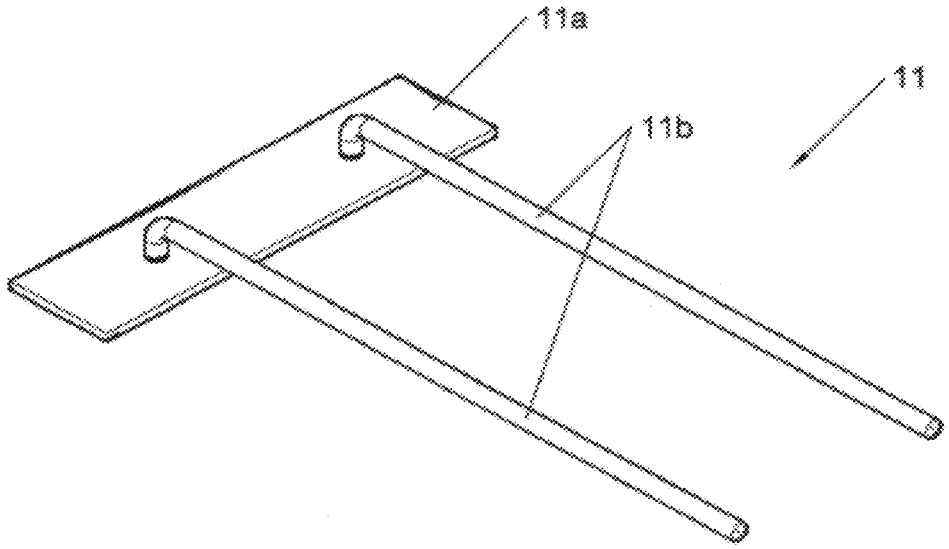
FIG. 9 is a perspective view of an exemplary embodiment of a typical panel end embedded weld plate.
Figure 10:
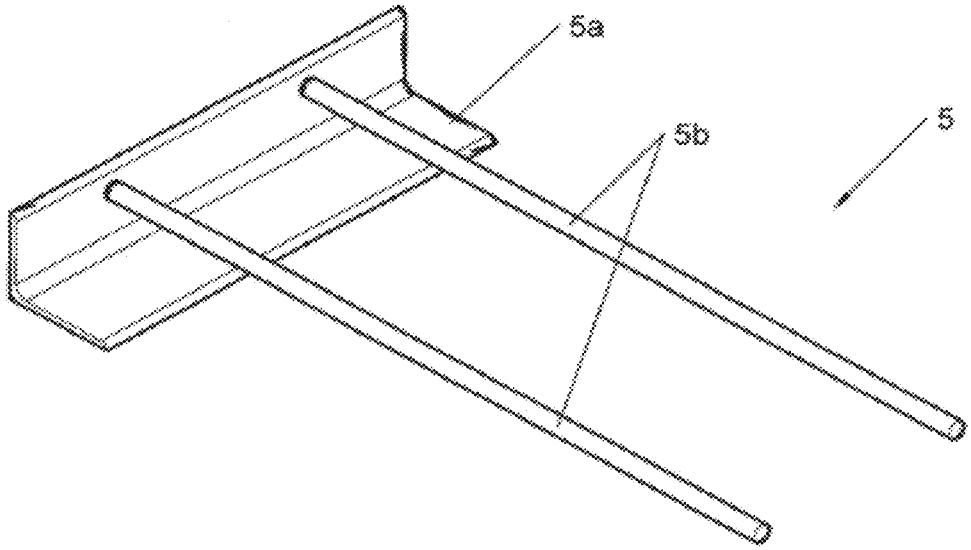
FIG. 10 is a perspective view of an exemplary embodiment of a typical panel edge embedded weld plate.
Figure 11:
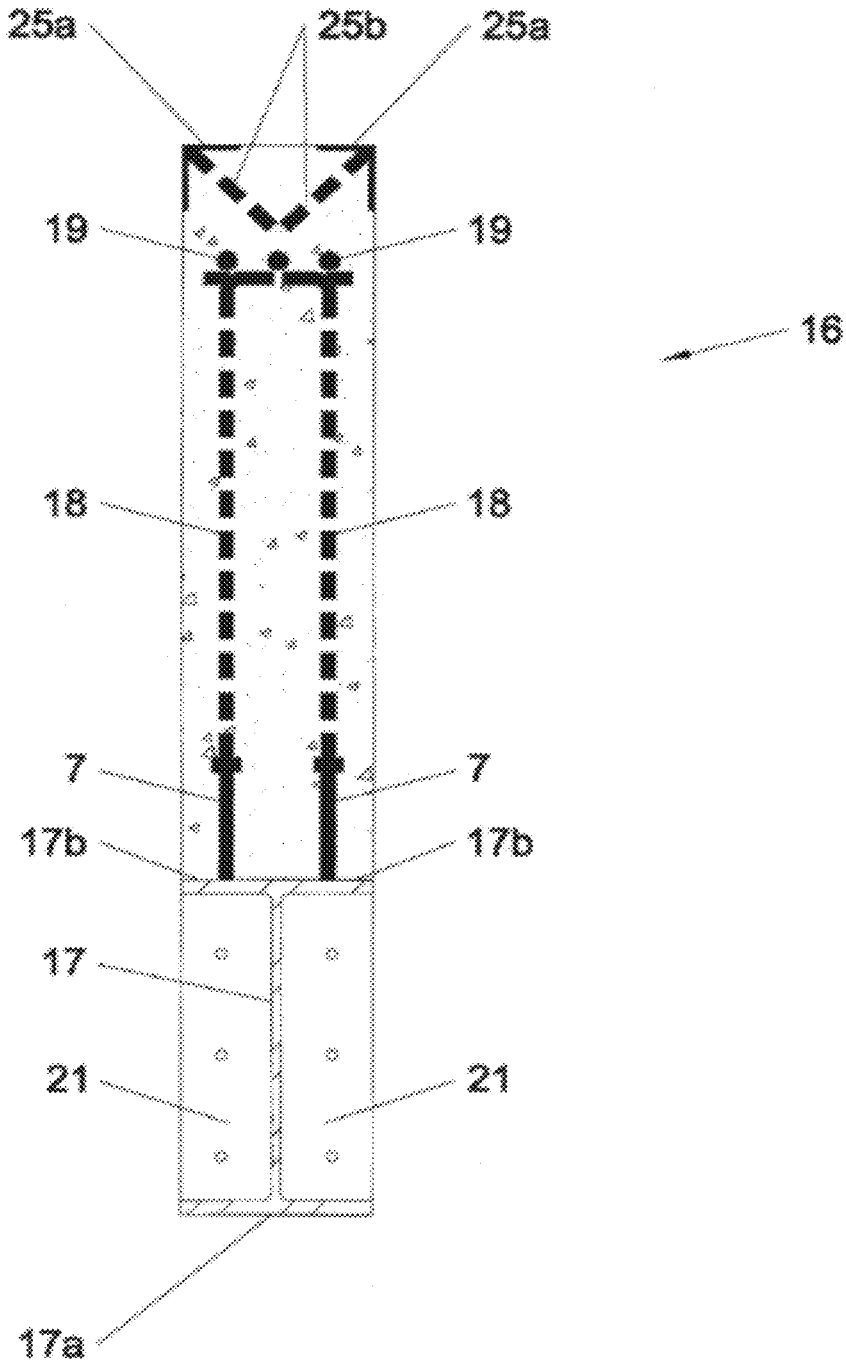
FIG. 11 is a cross-sectional view of an exemplary embodiment of a composite panel.
Figure 12:
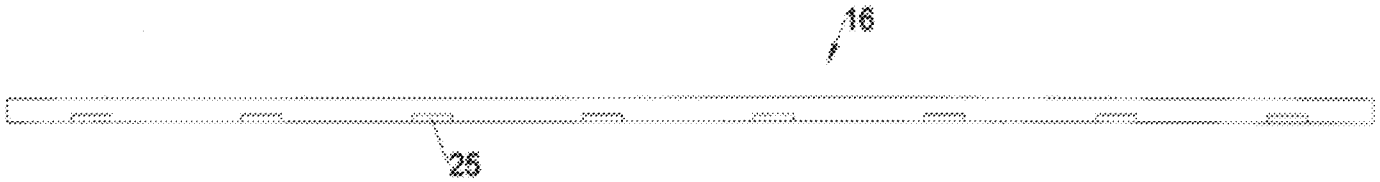
FIG. 12 is a plan view of an exemplary embodiment of a composite girder.
Figure 13:
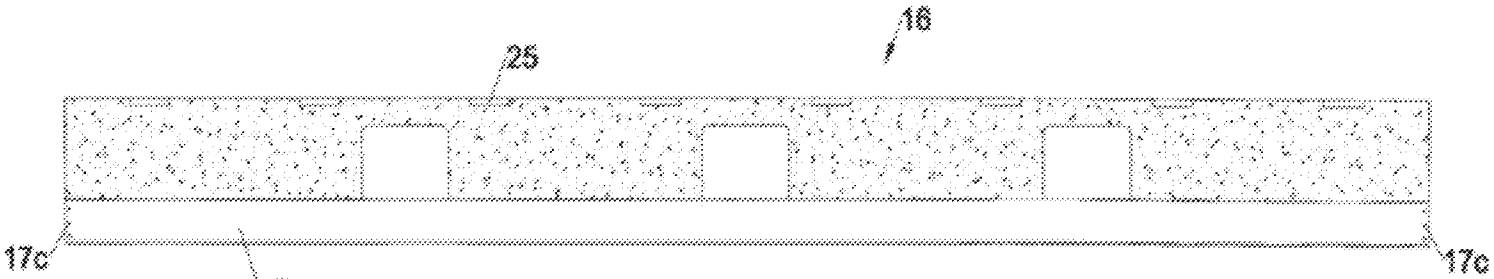
FIG. 13 is a side elevation view of an exemplary embodiment of a composite girder.
Figure 14:
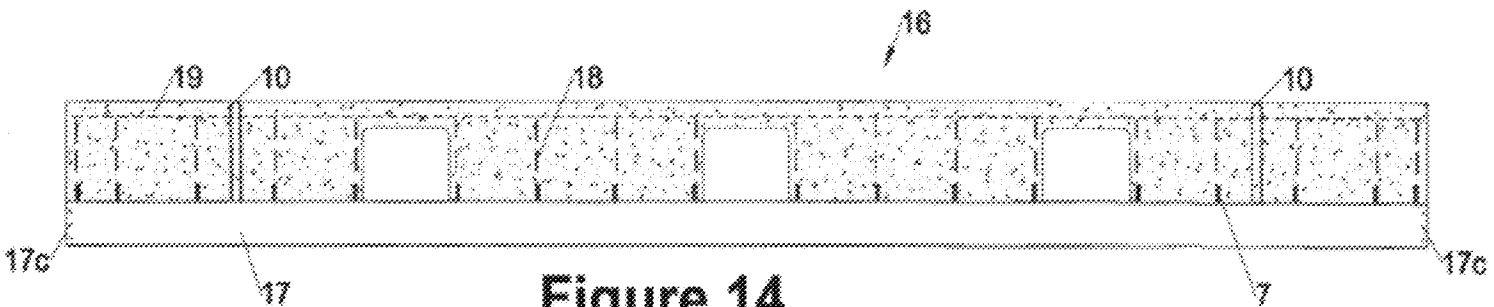
FIG. 14 is a cross-sectional side elevation view of an exemplary embodiment of a composite girder.

As shown in FIG. 2, a composite girder 16 for the present flooring system includes a concrete stem wall 12 and a steel wide flange beam 17. The beam 17 has rebar 18 (or another similar reinforcement) welded to the top flange of the steel beam 17. The rebar 18 extends into the stem wall 12. Shear plates are welded onto the steel girder beam and are used for connecting the panel steel beam 1 to the girder steel beam 17. The stem wall 12 includes openings 12*a* which may be used to run HV AC ducts, pipes, and electrical conduit. A sufficient amount of continuous concrete 12*b* (preferably between 50 and 33 percent of the height of the stem wall 12) is left above the openings 16*a* so as to provide sufficient compression strength to make a strong composite girder from the stem wall 16 and beam 17.

Figure 16:
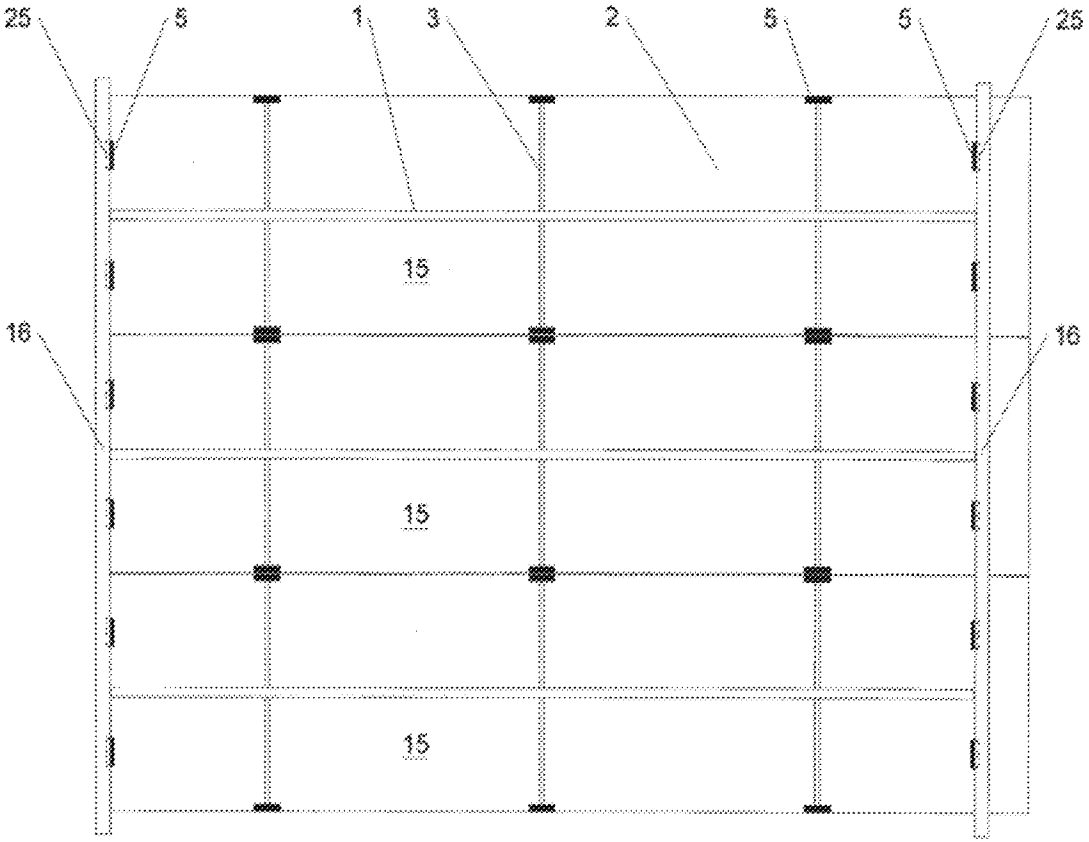
FIG. 16 is a bottom view of exemplary embodiment of three panels connected to a girder at each end.

The girder 16 is typically long enough to support several floor sections as shown in FIG. 16, and as such the steel beam 17 may be about 24 feet long. The steel beam 17 is typically the same height as the steel beam 1, and is thus typically 12 inches tall and between 4 and 8 inches wide. The stem wall 12 of the girder is typically between 12 and 36 inches tall, and typically matches the height of the stem wall 4 so that the floor deck 2 rests on top of the stem wall 12 when installed. The openings 12*a* in the stem wall 12 are typically about half as tall as the stem wall, and thus may be about 12 inches tall and 24 inches wide for a 24 inch stem wall.

Panel Construction

Figure 22:
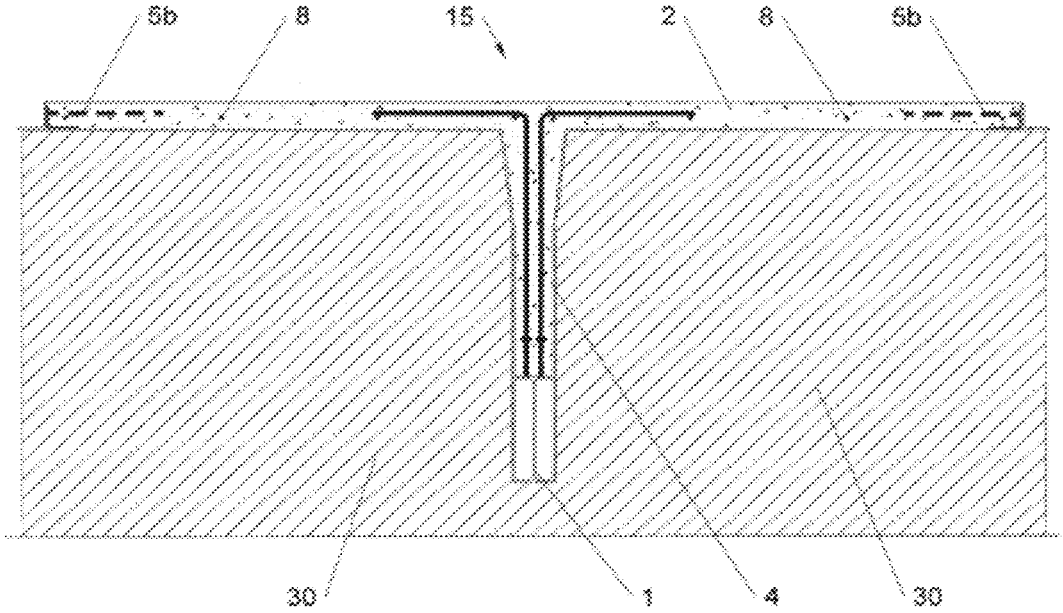
FIG. 22 is a cross sectional view of an exemplary embodiment of a composite panel in the casting form.

The composite panel 15 is cast in steel forms 30, as shown in FIG. 22. The structure of the forms can vary in length and width as well as construction so long as the inside shape of the form is the correct profile for the finished tee-shaped panel 15. The forms should be of sufficient strength to allow for numerous repetitive uses while maintaining the correct shape and configuration.

The structure of the floor panel 15 is illustrated in FIGS. 3-10, showing the completed panel and various parts thereof. The wide flange beam 1 for the panel 15 is cut to the appropriate length per shop drawings approved by the engineer of record. The holes 1*c* used for connecting the panel beam 1 to the girder beam 17 are then drilled into each end of the panel beam 1. The beam is then placed upright so that it is resting flush on its bottom flange 1*a*. Nelson studs 7 or similar connectors are then welded to the top side of the top flange 1*b*. Spacing of the nelson studs 7 is per approved shop drawings at intervals less than or equal to the maximum spacing allowed by prevailing building codes. Vertical L-shaped reinforcing bars 6 are then welded into place adjacent to the Nelson studs 7 which were previously welded to the top flange 1*b* of the beam. The vertical reinforcing bars 6 project upward from the top flange of the beam and then turns 90 degrees so that the short leg 6*a* of the L-shaped reinforcing bars 6 run horizontally and perpendicular to the longitudinal axis of the beam 1. The vertical reinforcing bars 6 are spaced according to the shop drawings approved by the engineer of record, typically with one vertical reinforcing bar 6 per every Nelson Stud 7.

Lifting loops 10 made from reinforcing bar which have been bent into u-shapes are welded to the top flange 1*b* of the beam at a point between the vertical reinforcing bars 6 where the concrete of the stem wall 4 will be poured to surround the lifting loops 10 and vertical reinforcing bars 6, leaving the tops of the lifting loops uncovered by concrete for lifting the panel with a crane. The length of the lifting loops 10 is approximately 0.25" less than the distance from the top side of the top flange 1*b* of the beam 1 to the top surface of the finished concrete slab 2. Lifting loops 10 are spaced at intervals determined by the overall length of the composite panel 15. Typically three lifting loops 10 are used per panel 15, with a minimum of two lifting loops on any single panel.

The beam assembly, consisting of the wide flange beam 1, lifting loops 10 and vertical L-shaped reinforcing bar 6, is then moved to a floor-mounted jig to hold it steady while the horizontal slab reinforcing rebar 8, 9 is tied to the horizontal leg 6*a* of the L-shaped vertical reinforcing bars 6. Reinforcing bars 9 running parallel to the longitudinal axis of the beam 1 are tied into place using standard tie wire to the underside of the horizontal leg 6*a* of the L-shaped reinforcing bar 6 which was welded to the beam 1. Horizontal reinforcing bars 8 running perpendicular to the longitudinal axis of the beam 1 are tied to the previously installed horizontal reinforcing bars 9 which are running parallel to the longitudinal axis of the beam 1. Reinforcing bars 8, 9 are cut to a length about two inches shorter than the overall length or width of the slab 2 in which they are to be cast. Horizontal reinforcing bars 8, 9 are typically tied with 16 gauge tie wire at all intersections.

Openings 4*a* in the concrete stem wall 4 are created by attaching a formed shape to the beam 1 between the vertical reinforcing bars 6. These openings 4*a* are typically referred to as blockouts. Blockout forms are made using a variety of materials, including but not limited to, styrene foam, rubber, wood and steel. The most common method of blockout form construction is styrene foam blocks which are secured to the beam 1 by use of tape or glue. The blockout forms are coated in form release oil or silicone to prevent it from bonding to the stem wall concrete 4 that is poured around it.

Weld plates 5, 11 are placed into the form bed and secured by tie wire or small bolts to hold the weld plates into position until the concrete has cured sufficiently. These weld plates are also referred to as embedded weld plates or simply as embeds. There are several configurations of weld plates 5, 11 used at different locations in the panel slab 2. The slab edge embed 5 consists of a short length of angle iron 5*a*, usually eight to twelve inches in length, with two straight reinforcing bars 5*b* welded to the inside of the angle 5*a* in a manner so that they extend out in the horizontal plane of the concrete slab 2 once they are placed in the forms. The weld plates 5, 11 are spaced at equal intervals along both sides of the concrete slab 2 and are used to connect adjacent panels 15 to each other at the slab 2 level.

Slab end weld plates 11 consist of short lengths of flat steel bar 11*a*, usually eight to twelve inches in length, with two L-shaped reinforcing bars 11*b* welded to one side of the flat bar and positioned so that he long leg of the L-shape will extend outward into the horizontal plane of the concrete slab 2 once they are placed in the forms. Slab end weld plates 11 are used to secure the panel slab 2 to the girder 16 below.

The beam assembly, consisting of the steel wide flange beam 1 with attached vertical reinforcing 6, the horizontal slab reinforcing 8, 9 and the stem wall blockout forms, is lifted and set into the forms which have been sprayed with form release oil. The weld plates 5, 11 have been tied or bolted to the forms and are then in contact with the horizontal reinforcing rebar 8, 9 and all bars of the weld plates 5, 11 are then tied with 16 gauge tie wire to intersecting reinforcing bars at each intersection.

Rebar chairs may be placed under the horizontal reinforcing 9 to maintain the minimum distance between the bottom surface 2*a* of the concrete slab 2 and the underside of the horizontal reinforcing 9. Rebar chairs are spaced as needed, as determined by visual inspection once the beam assembly has been set in place and all weld plates 5, 11 have been tied securely to the horizontal reinforcing 8, 9.

Concrete is placed in the forms in a manner to ensure that all reinforcing bar 8, 9 is sufficiently covered. The upper surface of the concrete slab 2*b* is finished to industry standards for concrete floors. Typically the panels 15 are covered by plastic or concrete blankets and heated air is introduced under the forms to accelerate curing of the concrete. Once the concrete has cured sufficiently the panel 15 is lifted out of the forms by the lifting loops 10 attached to the beam 1. The panel 15 is set on a flat, level surface and is held level by blocking, stands or other means acceptable to hold it level without putting excessive stresses on anyone point in the panel 15.

Braces 3 are then welded to the underside of the slab at the slab edge weld plates 5 and run diagonally down to intersect with the vertical web 1*d* of the wide flange panel beam 1. The brace 3 is welded to the beam 1 and the embed 5 so that in plan view the brace is perpendicular to the longitudinal axis of the panel beam 1. One brace 3 is attached at each slab edge embed 5.

The blockout forms are removed from the beam assembly leaving voids in the concrete stem wall 4. All bolts or tie wire which were used to secure the weld plates 5,11 in place before the concrete was formed and which are projecting from the concrete slab 2 are cut off flush with the bottom surface of the concrete slab 2*a*.

Girder Construction

Figure 23:
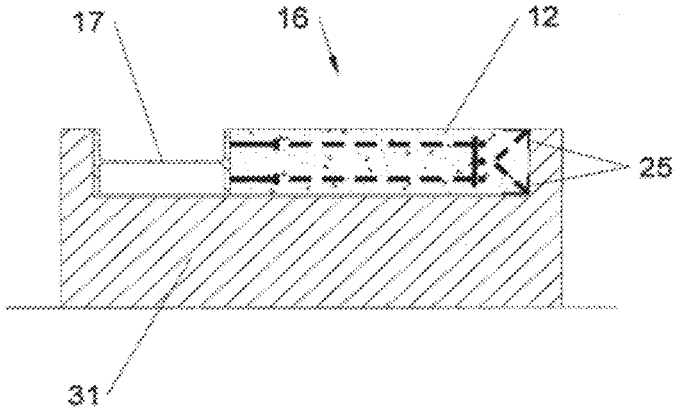
FIG. 23 is a cross sectional view of an exemplary embodiment of a composite girder in the casting form.

As shown in FIG. 23, the composite girder 16 is cast in steel forms 31. The structure of the forms can vary so long as the inside shape of the form is the correct profile for the finished composite girder 16. The forms should be of sufficient strength to allow for numerous repetitive uses while maintaining the correct shape and configuration.

FIGS. 11-15 show the various parts of the girder 16. The wide flange beam 17 for the girder 16 is cut to the appropriate length per shop drawings approved by the engineer of record. The holes 17*c* used for connecting the girder beam 17 to columns are then drilled into each end of the beam. The beam 17 is then stood upright so that it is resting flush on its bottom flange 17*a*. Nelson studs 7 or similar connectors are then welded to the top side of the top flange 17*b*. Spacing of the nelson studs 7 is per approved shop drawings at intervals less than or equal to the maximum spacing allowed by prevailing building codes. Vertical L-shaped reinforcing bars 18 are then welded into place adjacent to the Nelson studs 7 which were previously welded to the top flange 17*b* of the beam. The vertical reinforcing bar 18 projects upward from the top flange 17*b* of the beam and then turns ninety degrees to project horizontally and perpendicular to the longitudinal axis of the beam 17. The vertical reinforcing bars 18 are spaced according to the shop drawings approved by the engineer of record, typically with one vertical reinforcing bar 18 per every Nelson Stud 7.

Lifting loops 10, made from reinforcing bar which has been bent into a u-shape, are welded to the top flange 17*b* of the beam. The length of the lifting loops 10 is approximately 0.25" less than the distance from the top side of the top flange 17*b* of the beam to the top surface of the girder stem wall. Lifting loops 10 are spaced at intervals determined by the overall length of the composite girder 16. A minimum of two lifting loops 10 are used on any single girder 16.

The beam assembly, consisting of the wide flange beam 17, lifting loops 10 and vertical L-shaped reinforcing bar 18, is then moved to a floor-mounted jig to hold it steady while the horizontal reinforcing 19 is tied to the horizontal leg of the I-shaped vertical reinforcing bars 18 which have been welded to the beam 17. Reinforcing bars 19 running parallel to the longitudinal axis of the beam 17 are tied into place using 16 gauge tie wire to the top side of the horizontal leg 18*a* of the L-shaped reinforcing bar 18 which was welded to the beam 17.

Blockouts or openings 12*a* in the concrete of the girder 16 are created by attaching a formed shape to the beam 17 between the vertical reinforcing bars 18 which were welded to the beam 17. The blockouts 12*a* in a girder 16 are formed in the same manner as the blockouts in a panel stem wall 4.

Figure 15:
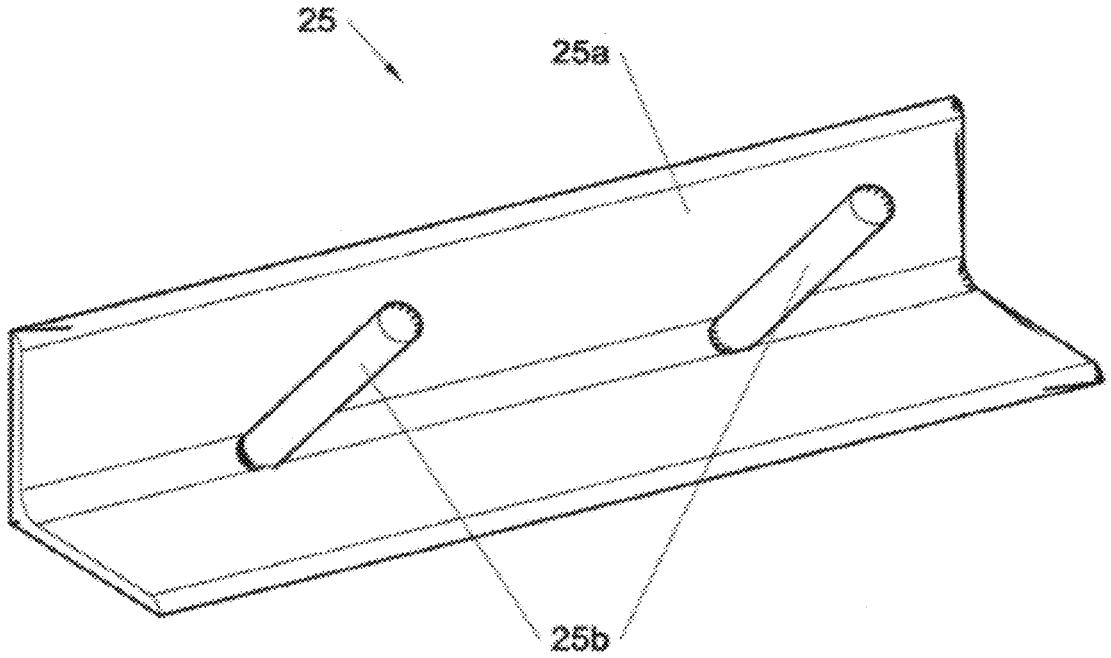
FIG. 15 is a perspective view of an exemplary embodiment of a girder embedded weld plate.

The girder beam assembly is placed into the forms 31 on its side (although they could also be poured vertically. Rebar chairs 14 are used as necessary to keep the rebar 19 away from the form bed. Weld plates 25 (as shown in FIG. 15) are placed in the form at the desired intervals, and are typically secured to the forms as discussed above with respect to the floor panels 15. Concrete is placed in the forms in a manner to ensure that all reinforcing bar 19 is sufficiently covered, typically leaving the tops of the lifting hoops 10 not covered in concrete. The side of the concrete girder 16 which is now in the horizontal position is finished to industry standards for concrete floors. The girders 16 are covered by plastic or concrete blankets and heated air is introduced under the forms to accelerate curing of the concrete. Once the concrete has cured sufficiently the girder 16 is lifted out of the forms by the lifting loops 10 attached to the beam 17.

Floor Assembly

FIGS. 16 through 20 show a floor assembly and various details of the floor assembly. The girders 16 of the floor system are installed first. A girder 16 is lifted by a crane attached to the lifting loops 10 which were welded to the girder beam 17 and embedded in concrete. Girders 16 are attached to standard steel columns through bolted connections at the ends of the girders, using holes 17*c*. Welded connections can be specified by the engineer of record if it is deemed necessary.

Once the girders 16 are in position, the panels 15 can be installed. A panel 15 is lifted by a crane secured to the lifting loops 10 which were welded to the panel beam 1 and embedded into the concrete of the stem wall 4. The panel 15 is set into place so that the vertical web 1*c* of the panel beam 1 is in line with the appropriate shear tab 21. The shear tabs are welded inside the girder beam 17, connecting to the top flange, bottom flange, and web as shown. A separate bolt plate 20 is attached to both the girder shear tab 21 and the panel beam 1 with bolts. The bolted connection transfers all of the gravity forces acting on the panel 15 into the girder beam 17.

Figure 17:
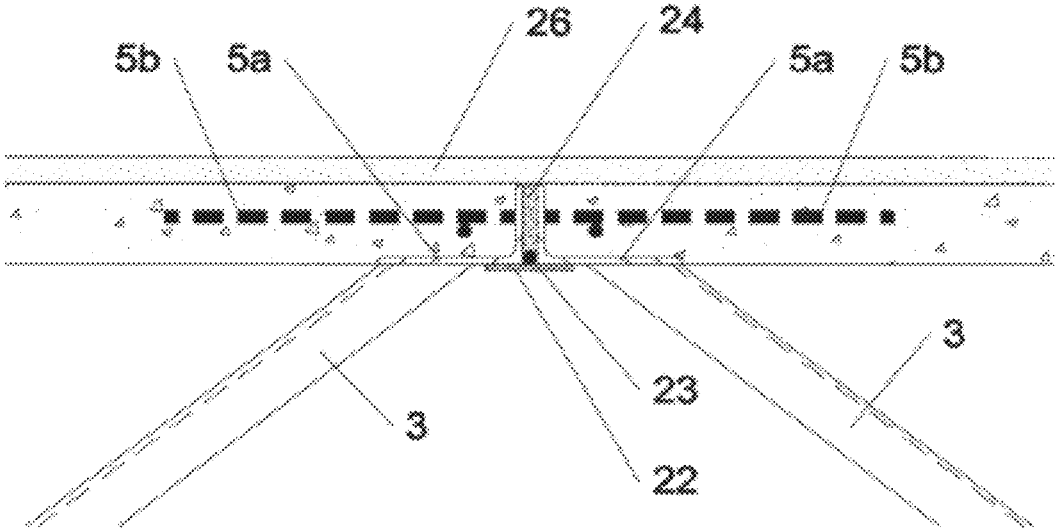
FIG. 17 is a cross-sectional view through a panel to panel connection at the slab edge weld plates.
Figure 18:
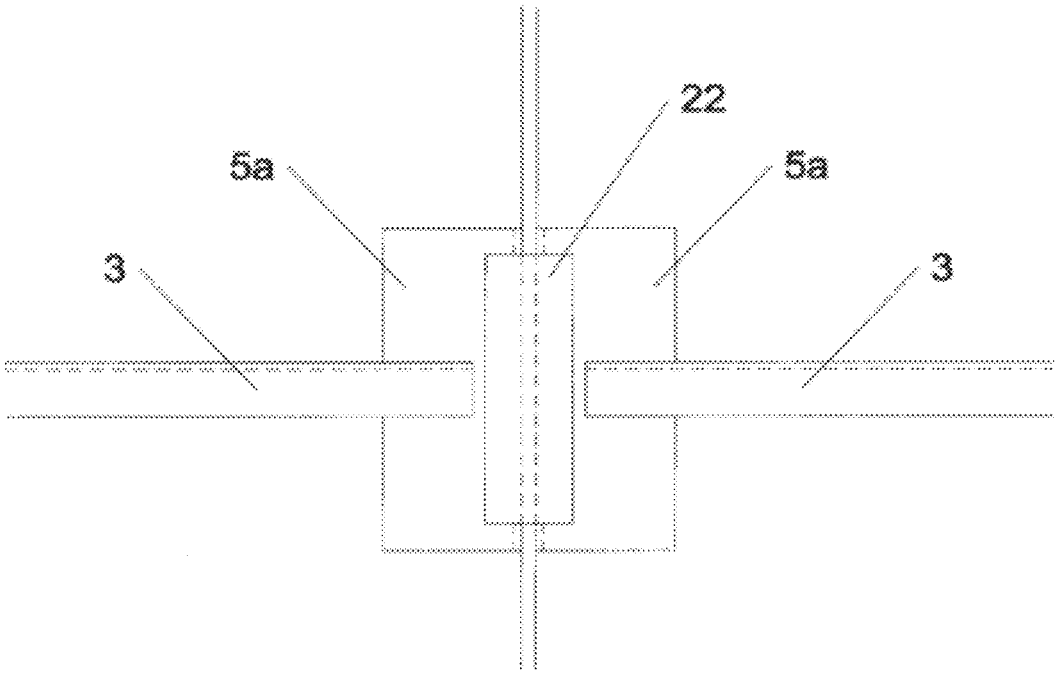
FIG. 18 is a bottom view of an exemplary embodiment of a panel to panel connection at the slab edge weld plates.
Figure 19:
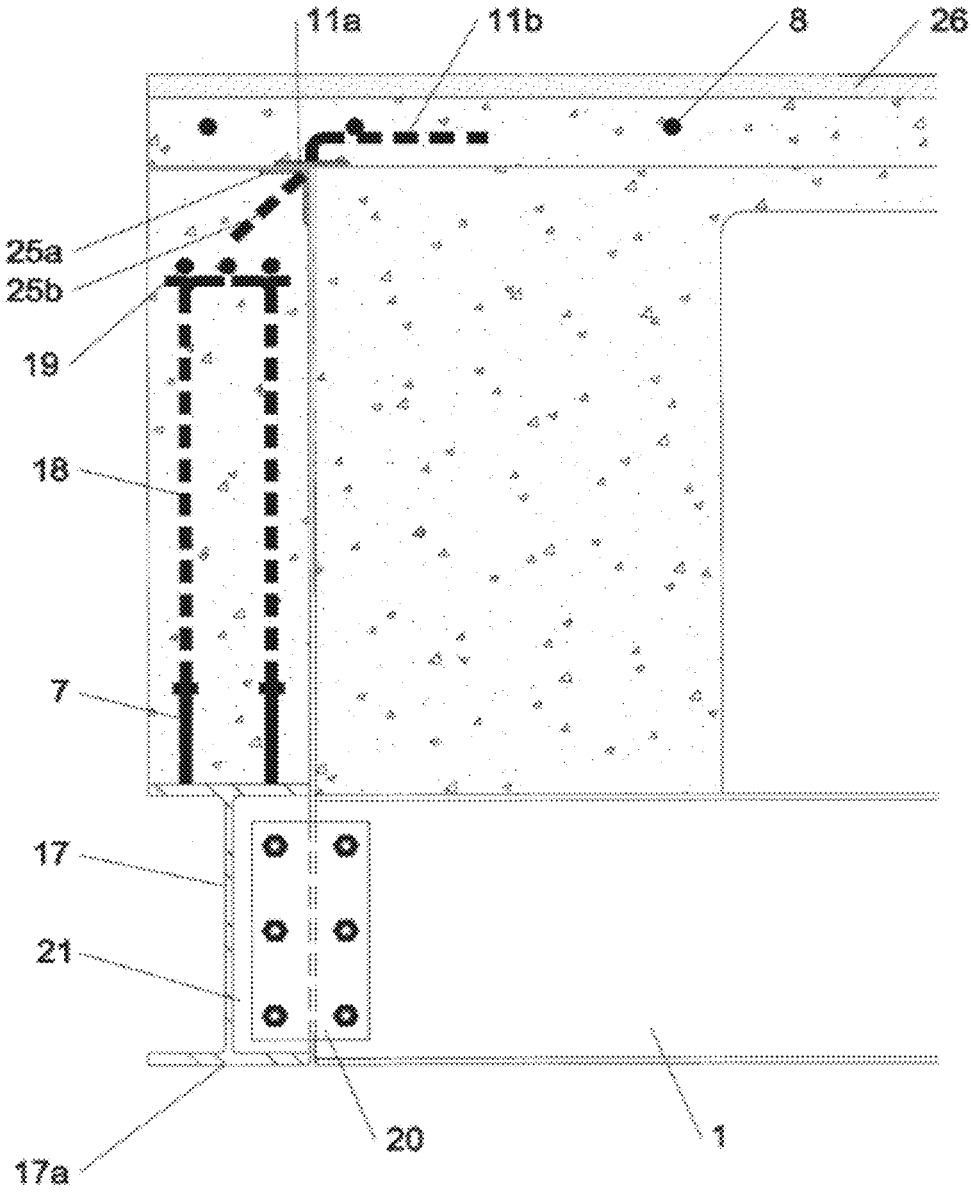
FIG. 19 is a cross-sectional view of an exemplary embodiment of a panel to girder connection plate at the centerline of the longitudinal axis of the panel.
Figure 20:
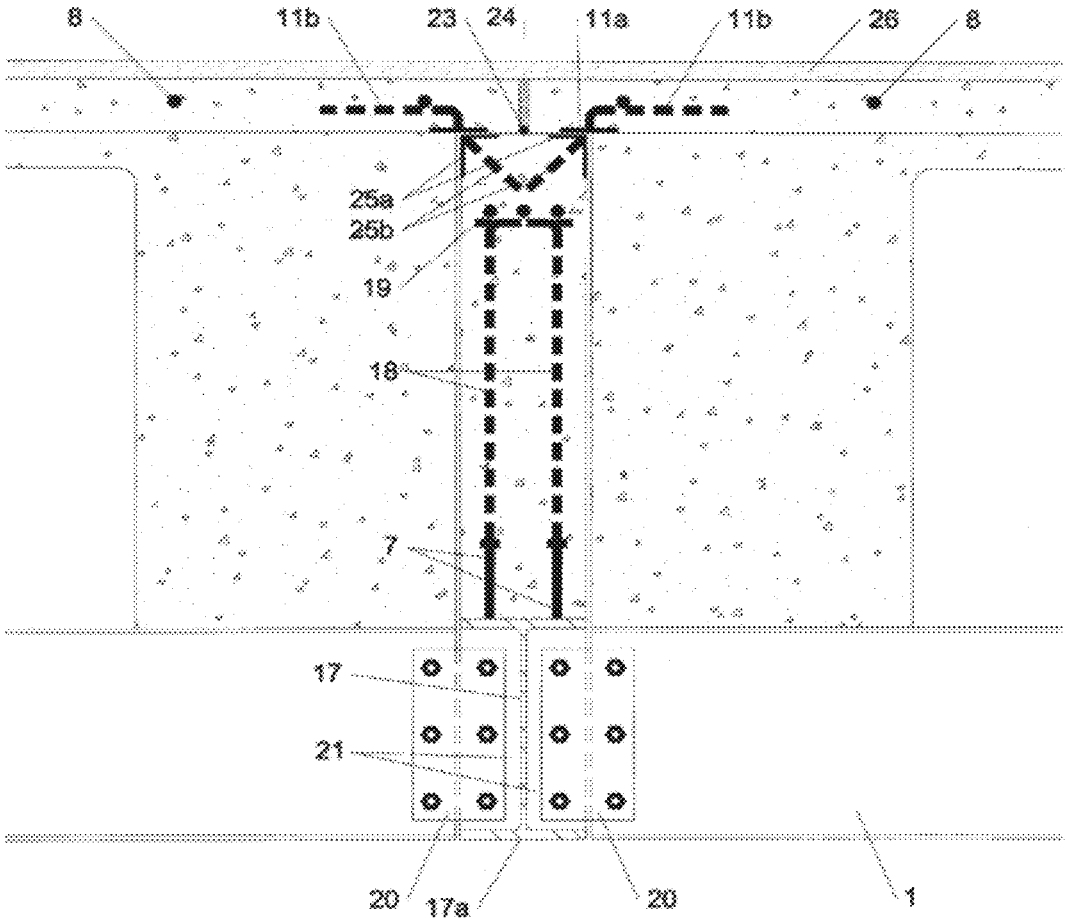
FIG. 20 is a cross-sectional view of an exemplary embodiment of a panel to girder connection plate, with panels on both sides of the girder, at the centerline of the longitudinal axis of the panels.
Figure 21:
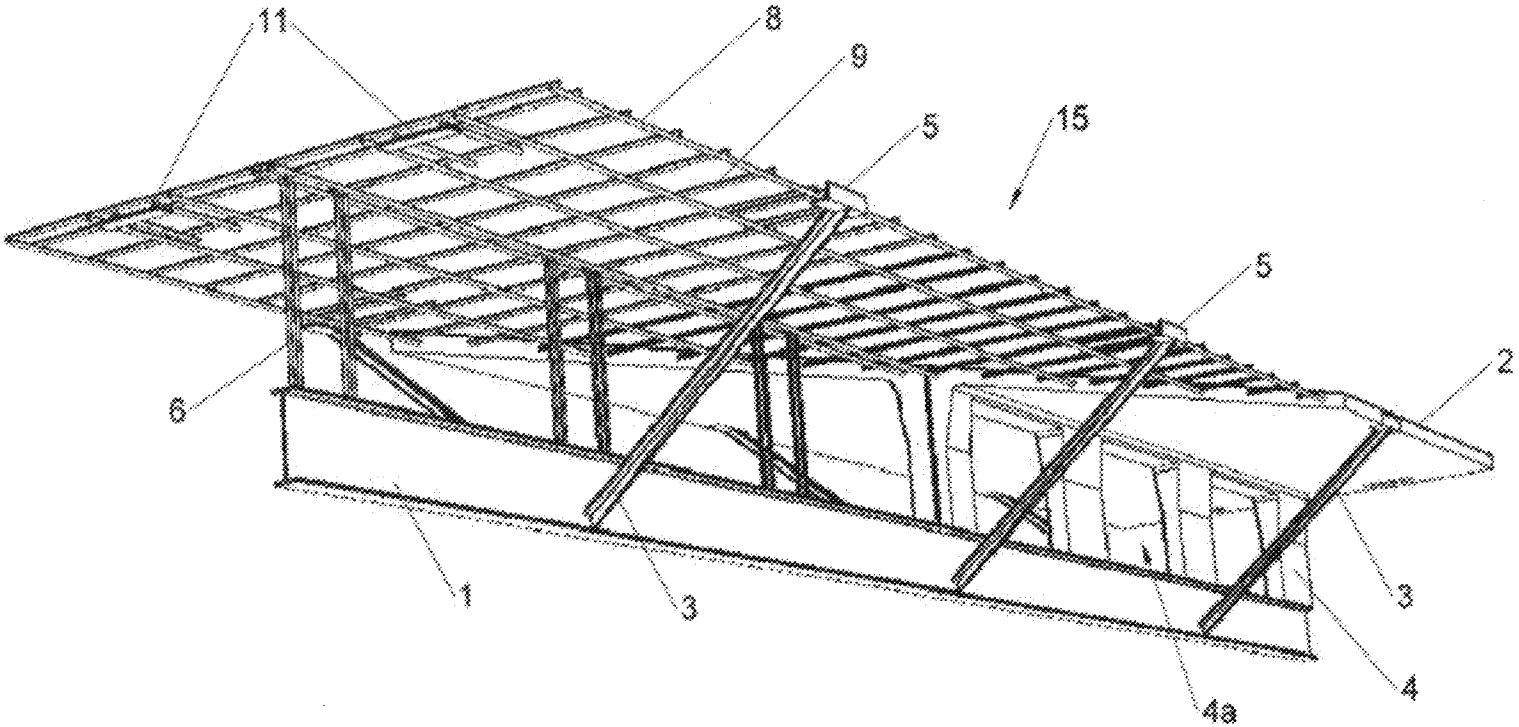
FIG. 21 is a cross-sectional perspective view of an exemplary embodiment of a composite panel.

Floor panels 15 are connected to each other through the embedded weld plates 5*a* at the slab edges. Lateral forces are transferred through these connections at the slab edge. As shown in FIG. 16, a flat steel bar 22 of sufficient strength is welded to the underside of two adjacent weld plates 5 to bridge the weld plates. The minimum amount of weld is typically specified by the engineer of record on the project. As is seen in FIG. 17, Panels 15 are typically placed with a small gap between the edges of the concrete slab 2. Foam backer rod 23 is inserted into the gap and the remainder of the void is filled with non-shrink grout 24.

The underside of the panel slab 2 is attached to the top of the girder 16 by welding the embedded weld plate 11 in the bottom of the slab 2 to the embed weld plate 25 in the top of the girder 16. Once all of the floor panels 15 are in place and all joints have been filled with grout 24 a lightweight topping of concrete 26 is often poured over the floor slabs 2 to provide the final wear surface and level out any variations in the slab elevations.

Figure 24A:
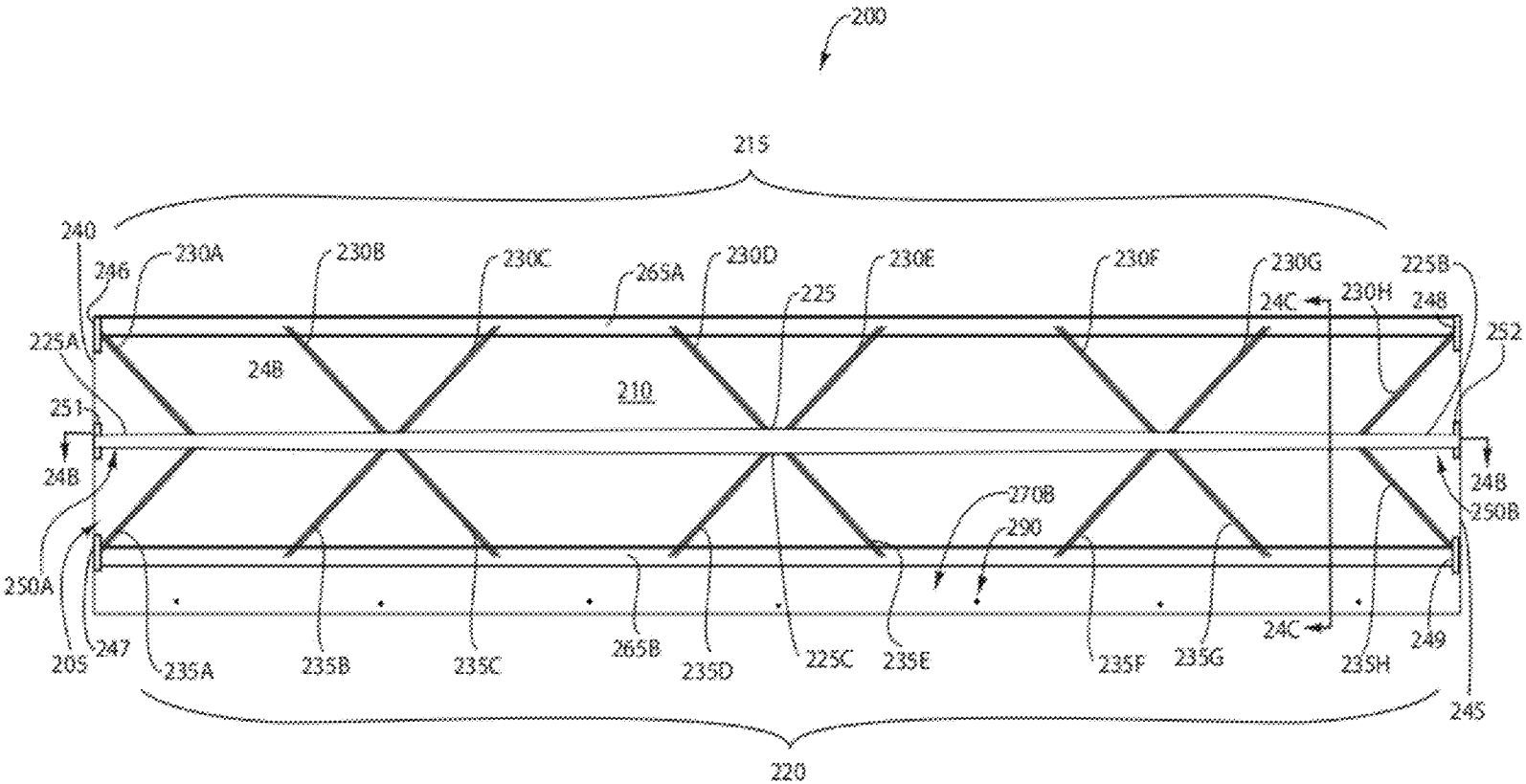
FIG. 24A is a bottom plan view of an exemplary embodiment of a composite panels.
Figure 24B:
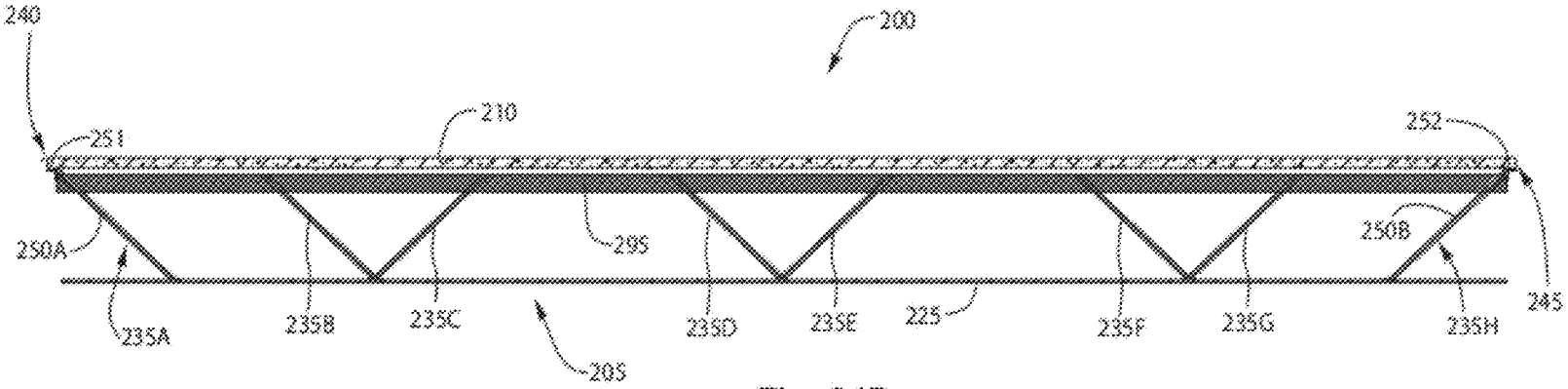
FIG. 24B illustrates a cross sectional view of the composite panel of FIG. 24A taken along section 24B-24B of FIG. 24A.
Figure 24C:
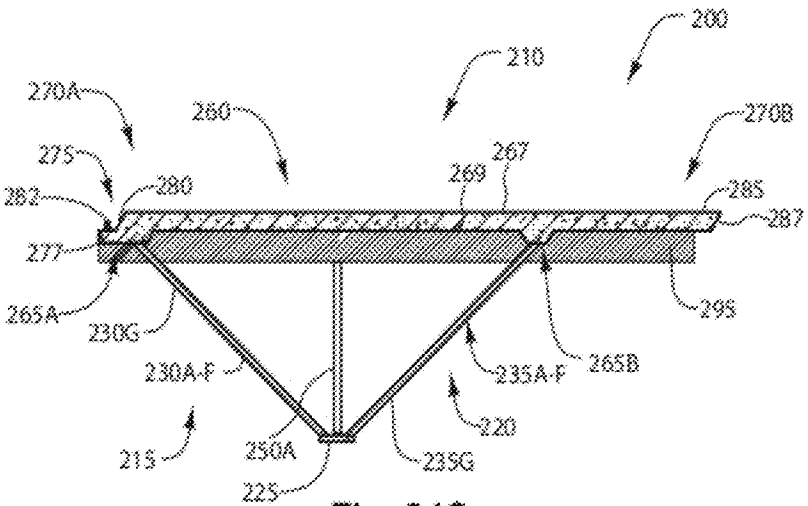
FIG. 24C illustrates a cross sectional view of the composite panel of FIG. 24A taken along section 24C-24C of FIG. 24A.

FIGS. 24A-24C illustrate an alternative embodiment of a composite panel 200. In particular, FIG. 24A is a bottom plan view of the composite panel 200. The composite panel 200 can include a frame assembly 205 that is coupled to and supports a concrete portion 210. The configuration of the frame assembly 205 will first be introduced with reference to the concrete portion 210 generally, after which the configuration of the concrete portion 210 will be discussed in more detail. Thereafter, the structural relationships between the frame assembly 205 and the concrete portion 210 will be discussed in more detail.

As illustrated in FIG. 24A, the frame assembly 205 includes a first lateral set of support members 215, a second lateral set of support members 220, and a base plate 225 that is offset from the concrete portion 210. Each of the first and second sets of lateral support members 215, 220 can have a first end coupled to the concrete portion 210 and a second end coupled to the base plate 225. The base plate 225 could also be a steel tension member, steel bottom cord or steel bottom flange. The first set of lateral support members 215 can include a plurality of supports, such as supports 230A-230H that extend from the concrete portion 210 to the base plate 225.

In at least one example, the supports 230A-230H are oriented such that the supports 230A-230H are positioned in a common plane as shown more clearly in FIG. 24C. For example, FIG. 24C illustrates at least a portion of the first set of lateral support members 215 being aligned in at least one common plane with support 230G shown and supports 230A-230F positioned behind support 230G and thus hidden from view in FIG. 24C. Further, the supports 230A-230H can be secured to the base plate 225 in any suitable manner at any number of desired locations. In at least one example, the supports 230A-230H are secured to the base plate 225 in such a manner that junctions between the supports 230A-230H and the base plate 225 lie in a line.

As also shown in FIG. 24A, the second set of lateral support members 220 can include a plurality of supports, such as supports 235A-235H. In the illustrated example, the supports 235A-235H can be oriented and positioned such that the supports 230A-230H lie in a common plane that is different than the common plane with respect to supports 230A-230H, as shown more clearly in FIG. 24C. For example, FIG. 24C illustrates at least a portion of the second set of lateral support members 220 being aligned in at least one plane with support 235G shown and supports 235A-235F positioned behind support 235G and thus hidden from view in FIG. 24C. In the illustrated example, the supports 235A-235H lie in a plane that is oriented at an angle to the plane in which supports 230A-230H lie.

The supports 235A-235H can be secured to the base plate 225 in any suitable manner at any number of desired locations. In at least one example, the supports 235A-235H are secured to the base plate 225 in such a manner that junctions of the supports 235A-235H and the base plate 225 lie in a line on the base plate 225. In at least one example, the junctions between the base plate 225 and the supports 235A-235H and the junctions between the base plate 225 and the supports 230A-230H all lie in a common plane on the base plate 225. It will be appreciated that other configurations are also possible.

In addition, one or more of the supports 230A-230H of the first set of lateral support members 215 can be joined at substantially the same location on the base plate 225 as one or more of the supports 235A-235H of the second set of lateral support members 215. In particular, as shown in FIG. 24A, supports 230A and 235A can be secured to the base plate 225 at a common location. Similarly, supports 230B, 230C, 235B, and 235C can also be secured to the base plate 225 at another common location. Supports 230D, 230E, 235D, and 235E can also be secured to the base plate 225 at yet another common location, supports 230F, 230G, 235F, and 235G can be secured to the base plate 225 at yet another common location, and supports 230H and 235H can also be secured to the base plate 225 at still another common location.

As shown in FIG. 24A, the configuration and relative orientation of first and seconds sets of lateral support members 215, 220 can cause the frame assembly 205 to form a plurality of trusses with the concrete portion 210. For example, a group or web of trusses can be formed that include a truss formed by supports 230B and 230C and the concrete portion 210, another truss by supports 230C,235C and the concrete portion 210, yet another truss between supports 235C, 235B and the concrete portion 210, and still yet another truss between supports 235B and 230B. Similar groups or webs of trusses can also be formed with supports 230D, 230E, 235D, and 235E as well as with 230F, 230G, 235F, and 235G. Accordingly, supports 230B-230G cooperate with supports 235B-235G to form truss webs on an interior portion of the composite panel 200 relative to end edges 240, 245 of the concrete portion 210.

According to one embodiment of the invention, the first and second sets of lateral support members 215, 220 can be secured to the concrete portion 210 so as to have substantially similar distances between first ends of adjacent supports. For example, in one embodiment, the distance between the first end of support 230A and the first end of support 235A is substantially equal to the distance between the first end of support 230A and the first end of support 230B, which can be substantially equal to the distance between the first end of support 235A and the first end of support 235B, which can be substantially the same distance between the first end of support 230B and the first end of support 230C, and so forth. In another embodiment, the distance between the first end of support 230B and the first end of support 230C is substantially equal to the distance between the first end of support 235B and the first end of support 235C.

As also shown in FIG. 24A, supports 230A, 235A can extend toward the end edge 240 while supports 230H, 235H extend toward the end edge 245. In the illustrated example, a girder connection plate 246 is provided which can be secured to concrete portion 210 and to the first end of support 230A, and another girder connection plate 247 is provided which can be secured to concrete portion 210 and to the first end of support 235A. Similarly, another girder connection plate 248 is provided which can be secured to concrete portion 210 and to the first end of support 230H, and yet another girder connection plate 249 is provided which can be secured to concrete portion 210 and to the first end of support 235H.

In at least one example, the supports 230A-230H, 235A-235H, can be formed of a high-strength material, such as steel. For example, the supports 230A-230H, 235A-235H, can be formed from rolled steel angle members and/or heavy gauge bent shapes. The girder connection plates 247-249 can also be formed of a high-strength material, such as steel, including rolled steel angle members and/or heavy gauge bent shapes.

In at least one example, the base plate 225 can be a steel plate with a thickness of between about ⅜ inch and about ⅝ or more. Further, as shown in FIG. 24A, the base plate 225 can be shaped such that the base plate 225 is relatively narrower at end portions 225A, 225B and wider near a central portion 225C of the base plate 225. For example, the base plate 225 can have end widths of between about five inches and about eight inches and a center width of between about four inches and about six inches. Such a configuration can provide relatively more material, such as steel, near the center of the composite panel 200 thereby increasing the section modulus and the moment of inertia at the center of the span where the greater capacity may be desirable, which in turn can allow for better performance for a given amount of material. In other examples, the base plate 225 can have a constant width or can have a relatively narrower central portion 225C than at end portions 225A, 225B. Accordingly, the base plate 225 can be configured as desired to provide a base for the supports 230A-230H, 235A-235H. The base plate 225 can also provide a base for additional supports.

FIG. 24B illustrates a cross sectional view of the composite panel 200 taken along section 24B-24B of FIG. 24A. As shown in FIG. 24B, the frame assembly 205 also includes end supports 250A, 250B coupled at a first end to the concrete portion 210 and coupled at a second end to the base plate 225. In the example shown in FIG. 24B, the end supports 250A, 250B can extend from the concrete portion 210 to the base plate 225. According to one embodiment, end support 250A can be positioned relative to base plate 225 and concrete portion 210 such that support 235A is positioned directly behind end support 250A as illustrated. In this orientation, end support 250A and support 235A, and likewise support 230A, can all share a common plane. Similarly, end support 250B and supports 235H,230H can be aligned and thus share a common plane, as partially illustrated in FIG. 24B.

As shown in the illustrated embodiment, a girder connection plate 251 is provided which can be secured to end support 250A, and another girder connection plate 252 is provided which can be secured to a similar end support 250B positioned on the opposing end of the composite panel 200. In the illustrated example, the girder connection plate 251 is positioned beneath the end edge 240 of the concrete portion while girder connection 252 is positioned beneath the opposing end edge 245 of the concrete portion 210. Such configuration can allow the girder connection plates 251, 252 to thereby support opposing ends of the concrete portion 210. Referring again briefly to FIG. 24A, girder connection plates 247-249 can be secured to concrete portion 210 in a similar manner such that the girder connection plates 247-249 are positioned beneath the corresponding end edges 240, 245.

Support member 215 can be positioned in a corresponding manner with the position of support members 220, such that adjacent supports can share a common plane. For example, FIG. 24B illustrates support members 215 being connected to base plate 225 and extending toward concrete portion 210 at an angle with respect to base plate 225. Support members 225 can have a corresponding angle with respect to base plate 225. According to one embodiment, support 230A and support 235A have a substantially similar angle from the base plate 225 such that support 230A and support 235A share a common plane. Similarly, end support 250A can have a substantially similar angle from the base plate 225 as support 230A and support 235A, thus rendering supports 230A, 235A and end support 250A to be substantially aligned in a common plane. Similarly, support 230B can share a common plane with support 235B as a result of a substantially similar angle between support 230B and base plate 225 and between support 235B and base plate 225. Likewise, supports 230C, 235C can share a common plane, supports 230D,235D can share a common plane, supports 230E,235E can share a common plane, supports 230F,235F can share a common plane, supports 230G,235G can share a common plane, and supports 230H,235H and end support 250B can share a common plane, each resulting from a similar angle between corresponding supports and the base plate 225.

FIG. 24C is a cross sectional view of the composite panel 200 taken along section 24C-24C of FIG. 24A and illustrates the structure of the concrete portion 210 in more detail. As illustrated in FIG. 24C, the concrete portion 210 generally includes a slab portion 260, a first beam portion 265A, and a second beam portion 265B. The slab portion 260 shown includes a generally planar top surface 267, a first lateral portion 270A and a second lateral portion 270B.

In the illustrated example, the first lateral portion 270A defines a channel 275 that is adapted to facilitate connection a first composite panel to a second composite panel. The channel 275 is formed by a ledge 277 that is recessed below a plane defined by the top surface 267. A shoulder 280 forms a transition between the ledge 277 and the top surface 267. In the example illustrated in FIG. 24C, the channel can include one or more bolts 282 that extend upwardly from the ledge 277, and are configured to facilitate connecting one composite panel to another composite panel.

In the illustrated example, the second lateral portion 270B has a shape that is complimentary to the channel 275 in the first lateral portion 270A to facilitate joining of composite panels together. Accordingly, the second lateral portion 270B can form a tab 285 that includes a shoulder 287 of a shape that is complimentary to the shoulder 280 of the first lateral portion 270A. In at least one example, holes 290 (best seen in FIG. 24A) are formed in the second lateral portion 270B and positioned the same distance relative to the shoulder 287 as the bolts 282 are positioned on the ledge 277 relative the shoulder 280 on the first lateral portion 270A (not shown in FIG. 24A).

As shown in FIG. 24C, the first beam portion 265A and the second beam portion 265B extend downwardly and away from the slab portion 260. In particular, the first beam portion 265A and the second beam portion 265B can be integrally formed with the slab portion 260. Further, the first beam portion 265A and the second beam portion 265B can extend longitudinally along the length of the composite panel 200. In at least one example, a center of the first beam portion 265A and a center of the second beam portion 265B can be separated by a distance of between about four feet and about five feet or more, but preferably the spacing between the first beam portion 265A and the second beam portion 265B is approximately five feet. The first and second beam portions 265A, 265B can have a width of between about four inches and about eight inches and a height of between about six inches and about eight inches. Accordingly, the first beam portion 265A and the second beam portion 265B can be thicker than the rest of the concrete portion 210, including the slab portion 260. The increased thickness of the first and second beam portions 265A, 265B can allow the first and second beam portions 265A, 265B to provide additional support for the remainder of the concrete portion 210. In at least one example, the frame assembly 205 is coupled to the concrete portion 210 by way of the first and second beam portions 265A, 265B, as will be described in more detail below.

Referring again to FIG. 24A, the first set of lateral support members 215 is coupled to the concrete portion 210 by way of the first beam portion 265A and the second set of lateral support members 220 is coupled to the concrete portion 210 by way of the second beam portion 265B. In particular, supports 230A-230H can couple to the first beam portion 265A and supports 235A-235H can couple to the second beam portion 265B. According to one embodiment, reinforcements, such as plates, rebar, anchors, and/or any other desired reinforcements can be placed within the concrete portion 210 to anchor the supports 230A-230H, 235A-235H, 250A-250B to the concrete portion 210 (collectively shown in FIGS. 24A-24C). As also shown collectively in FIGS. 24A-24C, supports 230A-230H, 235A-235H, 250A-250B can space the base plate 225 at a distance of between about four and five feet from a bottom surface 269 (best seen in FIG. 24C) of the slab portion 260. As will be appreciated, supports 215,220 can be modified to offset base plate 225 from slab portion 260 a desired distance.

As shown particularly in FIGS. 24B and 24C, the composite panel 200 can also include a layer of material 295 to facilitate, among other things, formation of the concrete portion 210 as well as provide an insulation layer to dampen sound and/or reduce unwanted transfer of heat. In one embodiment, the layer of material 295 is a foam insulation form. Foam insulation form 295 was omitted from FIG. 24A to focus on the configuration of the frame assembly 205. It will be appreciated that the foam insulation form 295 can be an integral part of the composite panel 200 that abuts the concrete portion 210 shown in FIG. 24A.

In at least one example, the foam insulation form 295 can have a shape that is the negative or inverse of the concrete portion 210, including any desired part of the slab portion 260 and/or the first and second beam portions 265A, 265B. Such a configuration can also provide a layer of floor insulation for both sound and temperature. Further, the foam insulation form 295 can also be used to house and otherwise preinstall a radiant floor heating and cooling system as desired. The foam insulation form 295 can be provided separately or can be used during the formation of the slab portion 260 and the first and second beam portions 265A, 265B. One exemplary method of forming the composite panel 200 will now be discussed in more detail. Though various steps will be described in an exemplary order, it will be appreciated that the steps described below can be performed in a different order and some steps can be omitted entirely as appropriate or desired. Further, steps can be combined and/or split as desired.

Referring collectively to FIGS. 24A-24C, forming the composite panel 200 can include securing the second ends of supports 215,220 and end supports 250A,250B to the base plate 225, forming a concrete portion 210 and securing the first ends of supports 215,220 and end supports 250A,250B to the concrete portion 210. Supports 215,220 and end supports 250A,250B can be secured to base plate 225 by various securing methods, such as welding or through a traditional fastener such as a threaded coupling (i.e. bolt).

After supports 215,220 and end supports 250A,250B are secured to base plate 225, the foam insulation form 295 is then positioned relative to the supports 230A-230H, 235A-235H, 250A,250B. The foam insulation form 295 can be supported in any suitable manner to maintain the foam insulation form 295 at a desired position and orientation relative to the base plate 225 and the supports 230A-230H, 235A-235H, 250A-250B.

Thereafter, reinforcements such as nelson studs 6, reinforcing rebar 8, 9 (all described above with reference to FIGS. 3-7) and any other reinforcement and/or intermediate supports can be positioned as desired relative to the foam insulation form 295. The reinforcements and/or intermediate members can be secured to each other and maintained in their position relative to the foam insulation form 295 in any manner desired, including through the use of wire, rebar chairs, and/or any other components as desired. In at least one example, lifting loops, similar to lifting loops 10 described above, can also be provided as desired. Such reinforcements can also be used to tie the first ends of supports 215,220, 250A,250B together or to simply position the first ends of supports 215,220,250A,250B in appropriate positions with respect to each other.

In one embodiment, securing the first ends of the supports 215,220,250A,250B to the concrete portion 210 can include forming a beam around at least a portion of the first end of a support. In an alternative embodiment, securing the first end of a support to the concrete portion can include securing at least a portion of the first end of the support to a reinforcement member, such as rebar or a metal plate or some other type of fixture designed to be enclosed within the beam. In this manner, the support is coupled or otherwise connected to the beam and ultimately to the concrete portion. The bolts 282 can also be positioned and/or secured to the reinforcements as desired, or can be simply anchored in the concrete.

Thereafter, the first and second beam portions 265A, 265B and at least a portion of the slab portion 260 can be formed by pouring concrete into the foam insulation form 295. Thereafter, the concrete can be cured and the composite panel 200 can be ready for assembly with other composite panels 200 to form a precast structural floor system 300 (FIGS. 25A-25B), as will be described in more detail below.

Accordingly, a composite panel 200 can be formed that includes first and second beam portions 265A, 265B that are thicker than other parts of the concrete portion 210. The first and second beam portions 265A, 265B support the slab portion 260 in two areas and can allow for better support both between the beam portions 265A, 265B and on the cantilever. Further, such a configuration can lead to a stiffer floor while reducing the amount of concrete utilized in other designs, such as some described herein previously. Accordingly, composite panels 200 can be formed that include a frame assembly 205 and a concrete portion 210. The composite panels 200 can then be used to form a pre-cast structural floor system, as will now be discussed in more detail.

Figure 25A:
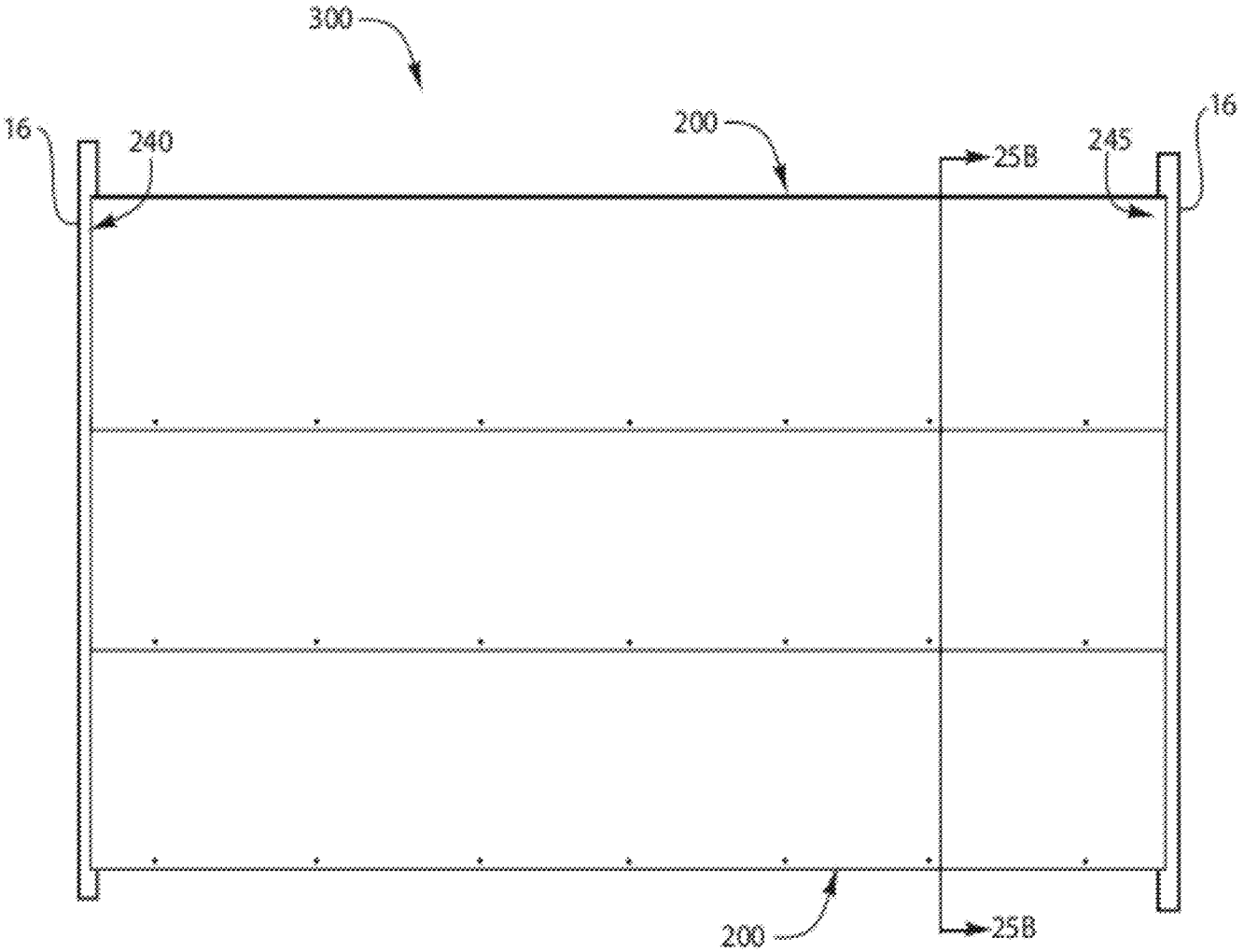
FIG. 25A illustrates a top plan view of an exemplary embodiment of a pre-cast structural floor system.
Figure 25B:
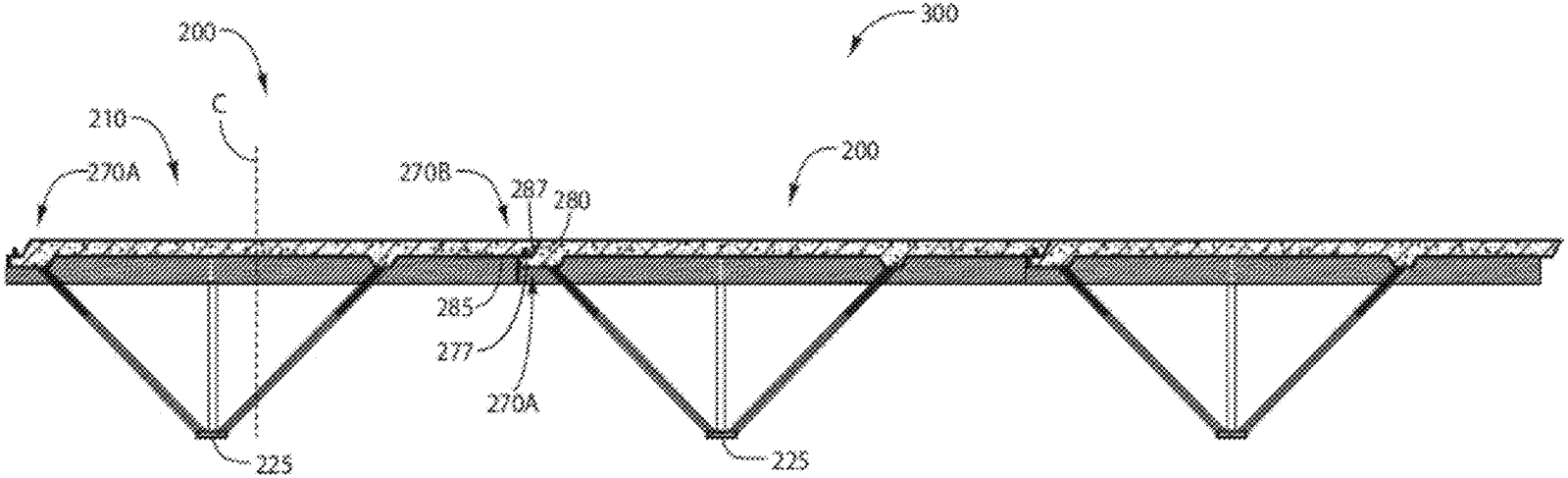
FIG. 25B illustrates a cross sectional view of the pre-cast structural floor system taken along section 25B-25B of FIG. 25A.

FIGS. 25A and 25B illustrate a precast structural floor system 300. In particular, FIG. 25A illustrates a top view of a precast structural floor system 300 while FIG. 25B illustrates a cross sectional view of the pre-cast structural floor system taken along section 25B-25B of FIG. 25A. In order to form the pre-cast structural floor system 300, girders 16 are placed at appropriate positions. One such example is shown in FIG. 25A in which girders 16 similar to those described above with reference to FIG. 16 have been provided. It will be appreciated that other girder configurations can also be used. As previously discussed, the composite panels 200 can include girder connection plates 247-249, 251-252 (best seen in FIGS. 24A and 24B) that are positioned beneath end edges 240, 245. The girder connection plates 247-249, 251-252 are secured to the rest of the frame assembly (FIG. 24A) in such a manner that allow the frame assembly 205 (FIG. 24A) to counter the tensile forces that would otherwise act on the end edges 240, 245 of the concrete portion 210. By directing the tensile forces to metallic portions of the composite panel, the composite panel 200 can thus be placed directly on the girders 16.

Accordingly, as shown in FIG. 25A, the end edges 240, 245 are overlappingly placed directly on the girders 16. Such a configuration can allow the composite panel 200 to be easily set onto the top of the girders 16. This in turn can allow for a crane to set the composite panels 200 quickly as each composite panel 200 can be positioned over the girders 16 and be lowered into place since the girder connection plates 247-249, 251-252 will engage the girders 16 directly while the rest of the composite panel 200 is positioned in the space between the girders 16.

FIG. 25B illustrates cross sectional view of the precast structural floor system 300 taken along section 25B-25B of FIG. 25A. As shown in FIG. 25B, various other components can allow the precast flooring system 300 to be readily assembled. Each of the holes 290 (FIG. 24A) in the second lateral portion 270B can be adapted to receive one of the corresponding bolts 282 (FIG. 24C) that extend from the ledge 277 of the first lateral portion 270A of an adjacent composite panel 200.

As shown in FIG. 25B, several composite panels 200 can be positioned next to each other such that the second lateral portion 270B of one composite panel 200 is mated to the first lateral portion 270A of an adjacent composite panel 200. The composite panels 200 can then be connected in any suitable manner.

As illustrated in FIG. 25B, the base plate 225 of each composite panel 200 can be offset from a center C of the concrete portion 210. In particular, the second lateral portion 270B is further from the base plate 225 in the horizontal direction than the first lateral portion 270A such that composite panel 200 will tip in the direction of the second lateral portion 270B when base plate 225 is positioned on a support surface.

As the composite panels 200 thus tip, the tab 285 on the second lateral portion 270B of one composite panel 200 is brought into contact with the first lateral portion 270A of an adjacent composite panel 200. As shown in FIG. 25B, a portion of the tab 285 is received within the channel 275 (FIG. 24C) in the first lateral portion 270A such that the tab 285 rests on the ledge 277 and the shoulder 280 on the ledge 277 abuts the shoulder 287 on the tab 285.

With the heavy end of one composite panel 200 set onto an adjacent composite panel 200, it can be easier for all of the composite panels 200 to be level, because the composite panels 200 will naturally want to tip onto the connection and once connected will help balance each other out.

Figure 26:
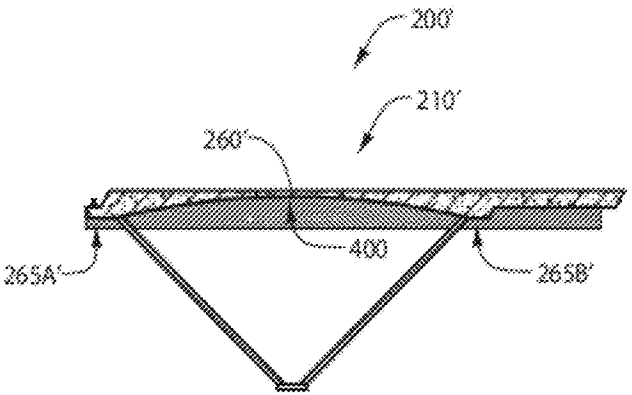
FIG. 26 illustrates an alternative embodiment of a composite panel.

FIG. 26 illustrates an end view of a composite panel 200' according to one example that includes a concrete portion 210' having alternative configuration. In the example shown in FIG. 26, girder connection plates and end supports have been omitted to focus on the shape of the concrete portion 210' though it will be appreciate that such components can be included as part of the composite panel 200'.

Accordingly, the composite panel 200' can be similar to the composite panel 200 described above except that an arch 400 is formed in the slab portion 260' between first and second beam portions 265A', 265B'. Such a configuration can provide a smooth transition between the first and second beam portions 265A', 265B', which can reduce stress risers within the slab portion 260' by reducing sharp corners.

According to an embodiment, a composite floor panel is disclosed comprising a concrete slab, and a frame assembly adapted to support the concrete slab, the frame assembly having a first and second set of support members, wherein each support member has a first end and an opposing second end, wherein each first end of the support members is coupled together and each second end of the support members is coupled to the concrete slab, wherein a first support member of the first set of support members shares a common plane with a first support member of the second set of support members and wherein the first support member of the first set of support members shares a common plane with a second support member of the first set of support members.

According to an embodiment, a composite floor panel is disclosed comprising: (i) a concrete slab, and (ii) a frame coupled to and adapted to support the slab, wherein the frame comprises: (a) a base plate, and (b) a plurality of support members each having a first end and a second end, wherein each of the first ends of the plurality of support members is coupled to the base plate at a common location on the base plate and each of the second ends of the plurality of support members is coupled to the concrete slab at distinct locations on the concrete slab thus causing the plurality of support members to be angled with respect to at least one of the concrete slab or each other.

According to an embodiment, a composite floor panel is disclosed comprising a concrete slab, and a frame assembly adapted to support the concrete slab, wherein the frame assembly comprises a plurality of support members coupled to the concrete slab, wherein the plurality of support members are angled with respect to at least one of the concrete slab and each other, wherein a first support member of the plurality of support members shares a first common plane with a second support member of the plurality of support members and wherein the first support member shares a second common plane with a third support member of the plurality of support members, wherein the first common plane is different than the second common plane.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A composite floor panel, comprising:

a frame assembly comprising a base, a plurality of first supports and a plurality of second supports, each support having a first end and an opposing second end, the second end of each of the plurality of first and second supports being coupled to the base; and a concrete portion comprising:

a slab portion having a first surface, a first beam portion coupled to the slab portion and extending away from the first surface of the slab portion, and a second beam portion coupled to the slab portion and extending away from the first surface of the slab portion, wherein the first beam portion is spaced apart from the second beam portion, wherein the first ends of the plurality of first supports are coupled to the first beam portion and the first ends of the plurality of second supports are coupled to the second beam portion; and wherein a portion of the slab portion between the first beam portion and the second beam portion forms an arch.

2. The composite floor panel of claim 1, wherein the slab portion includes a first lateral portion and a second lateral portion, wherein the first lateral portion includes a ledge and shoulder defining a channel that is recessed from a plane defined by the first surface of the slab portion and wherein the second lateral portion includes a tab having a shape complimentary to the ledge and shoulder of the first lateral portion.

3. The composite floor panel of claim 1, wherein the slab portion includes a first lateral portion and a second lateral portion, wherein an edge of the second lateral portion is further from the base with respect to a horizontal direction than an edge of the first lateral portion is from the base with respect to the horizontal direction when the base is positioned on a support surface.

4. The composite floor panel of claim 1, wherein the first supports lie in a first plane and the second supports lie in a second plane, the second plane being oriented at an angle relative to the first plane.

5. The composite floor panel of claim 4, wherein the first plane and the second plane intersect in a line approximate the base.

6. The composite floor panel of claim 5, wherein at least one pair of the first supports and at least another pair of the second supports substantially intersect at a common location on the base.

7. A composite floor panel comprising:

a concrete portion comprising:

an elongate concrete slab, the concrete slab having a generally flat upper surface;

a frame assembly comprising:

a base plate located a distance below the concrete slab and extending longitudinally along a length of the slab;

a first plurality of lateral supports attached to the base plate and extending upwardly to the slab and laterally a distance away from the base plate towards a first lateral edge of the slab;

a second plurality of lateral supports attached to the base plate and extending upwardly to the slab and laterally a distance away from the base plate towards a second lateral edge of the slab, the second lateral edge being opposite the first lateral edge of the slab; and wherein the first plurality of lateral supports attach to the concrete slab along a first longitudinal line, wherein the first lateral edge of the slab defines a channel having a ledge and a shoulder, wherein the second plurality of lateral supports attach to the concrete slab along a second longitudinal line, wherein the second lateral edge of the slab defines a tab which is complementary in shape to the channel, and wherein the second lateral edge is spaced apart from the second longitudinal line at a distance which is greater than a distance between the first lateral edge and the first longitudinal line.

8. The composite floor panel of claim 7, wherein the first plurality of lateral supports are attached to a first beam portion of the concrete slab, the first beam portion comprising a section of the slab having an increased thickness and extending longitudinally along the slab; and wherein the second plurality of lateral supports are attached to a second beam portion of the concrete slab, the second beam portion comprising a section of the slab having an increased thickness and extending longitudinally along the slab.

9. The composite floor panel of claim 7, wherein the first plurality of lateral supports are located in a first plane when viewed from an end of the floor panel, wherein the second plurality of lateral supports are located in a second plane when viewed from an end of the floor panel, and wherein the first plane and second plane extend upwardly from the base plate in a V shape.

10. The composite floor panel of claim 7, wherein the first plurality of lateral supports and the second plurality of lateral supports are disposed such that two of the first plurality of lateral supports and two of the second plurality of lateral supports are attached to the base plate at a common location and are disposed in an X shaped configuration when viewed from the bottom of the floor panel.

11. A composite floor panel comprising:

a concrete portion comprising:

an elongate concrete slab having a generally flat upper surface, a first lateral edge, a first longitudinal line, a second longitudinal line, and a second lateral edge;

a frame assembly attached to the concrete portion comprising:

a base plate located a distance below the concrete slab and extending along the length of the concrete slab between the first longitudinal line and the second longitudinal line;

a first plurality of lateral supports attached to the base plate and attached to the concrete portion along the first longitudinal line; and a second plurality of lateral supports attached to the base plate and attached to the concrete portion along the second longitudinal line; and wherein the first longitudinal line and the second longitudinal line are located along respective first and second beam portions of the concrete slab which have increased thickness compared to the concrete slab.

12. The composite floor panel of claim 11, wherein the base plate is equidistantly spaced laterally between the first longitudinal line and the second longitudinal line.

13. The composite floor panel of claim 11, wherein the first plurality of lateral supports comprises pairs of support members extending upwardly towards the concrete slab in a V shape and wherein the second plurality of lateral supports comprises pairs of support members extending upwardly towards the concrete slab in a V shape.

14. The composite floor panel of claim 11, wherein a pair of support members of the first plurality of lateral supports and a pair of support members of the second plurality of lateral supports are attached to the base plate at a common location and are disposed in an X shape when viewed from the bottom of the floor panel.

15. The composite floor panel of claim 11, wherein the first lateral edge comprises a channel and wherein the second lateral edge defines a tab which is complementary in shape to the channel.

16. The composite floor panel of claim 15, wherein the channel is spaced apart from the first longitudinal line a first distance and wherein the tab is spaced apart from the second longitudinal line a second distance greater than the first distance.

17. The composite floor panel of claim 11, wherein the base plate comprises a steel plate and wherein the first and second pluralities of lateral supports comprise elongate steel members.

18. The composite floor panel of claim 11, wherein the base plate is not connected to the concrete slab by a shear web.

19. A composite floor panel, comprising:

a frame assembly comprising a base, a plurality of first supports and a plurality of second supports, each support having a first end and an opposing second end, the second end of each of the plurality of first and second supports being coupled to the base; and a concrete portion comprising:

a slab portion having a first surface, a first beam portion coupled to the slab portion and extending away from the first surface of the slab portion, and a second beam portion coupled to the slab portion and extending away from the first surface of the slab portion, wherein the first beam portion is spaced apart from the second beam portion, wherein the first ends of the plurality of first supports are coupled to the first beam portion and the first ends of the plurality of second supports are coupled to the second beam portion; and wherein the slab portion includes a first lateral portion and a second lateral portion, wherein the first lateral portion includes a ledge and shoulder defining a channel that is recessed from a plane defined by the first surface of the slab portion and wherein the second lateral portion includes a tab having a shape complimentary to the ledge and shoulder of the first lateral portion.

20. A composite floor panel, comprising:

a frame assembly comprising a base, a plurality of first supports and a plurality of second supports, each support having a first end and an opposing second end, the second end of each of the plurality of first and second supports being coupled to the base; and a concrete portion comprising:

a slab portion having a first surface, a first beam portion coupled to the slab portion and extending away from the first surface of the slab portion, and a second beam portion coupled to the slab portion and extending away from the first surface of the slab portion, wherein the first beam portion is spaced apart from the second beam portion, wherein the first ends of the plurality of first supports are coupled to the first beam portion and the first ends of the plurality of second supports are coupled to the second beam portion; and wherein the slab portion includes a first lateral portion and a second lateral portion, wherein an edge of the second lateral portion is further from the base with respect to a horizontal direction than an edge of the first lateral portion is from the base with respect to the horizontal direction when the base is positioned on a support surface.

21. A composite floor panel comprising:

a concrete portion comprising:

an elongate concrete slab, the concrete slab having a generally flat upper surface;

a frame assembly comprising:

a base plate located a distance below the concrete slab and extending longitudinally along a length of the slab;

a first plurality of lateral supports attached to the base plate and extending upwardly to the slab and laterally a distance away from the base plate towards a first lateral edge of the slab;

a second plurality of lateral supports attached to the base plate and extending upwardly to the slab and laterally a distance away from the base plate towards a second lateral edge of the slab, the second lateral edge being opposite the first lateral edge of the slab; and wherein the first plurality of lateral supports are attached to a first beam portion of the concrete slab, the first beam portion comprising a section of the slab having an increased thickness and extending longitudinally along the slab; and wherein the second plurality of lateral supports are attached to a second beam portion of the concrete slab, the second beam portion comprising a section of the slab having an increased thickness and extending longitudinally along the slab.

22. A composite floor panel comprising:

a concrete portion comprising:

an elongate concrete slab having a generally flat upper surface, a first lateral edge, a first longitudinal line, a second longitudinal line, and a second lateral edge;

a frame assembly attached to the concrete portion comprising:

a base plate located a distance below the concrete slab and extending along the length of the concrete slab between the first longitudinal line and the second longitudinal line;

a first plurality of lateral supports attached to the base plate and attached to the concrete portion along the first longitudinal line; and a second plurality of lateral supports attached to the base plate and attached to the concrete portion along the second longitudinal line;

wherein the first lateral edge comprises a channel and wherein the second lateral edge defines a tab which is complementary in shape to the channel; and wherein the channel is spaced apart from the first longitudinal line a first distance and wherein the tab is spaced apart from the second longitudinal line a second distance greater than the first distance.

23. The composite floor panel of claim 22, wherein the base plate is equidistantly spaced laterally between the first longitudinal line and the second longitudinal line.

24. The composite floor panel of claim 22, wherein the first plurality of lateral supports comprises pairs of support members extending upwardly towards the concrete slab in a V shape and wherein the second plurality of lateral supports comprises pairs of support members extending upwardly towards the concrete slab in a V shape.

25. The composite floor panel of claim 22, wherein a pair of support members of the first plurality of lateral supports and a pair of support members of the second plurality of lateral supports are attached to the base plate at a common location and are disposed in an X shape when viewed from the bottom of the floor panel.

* * * * *